US009280073B1

(12) United States Patent
Tada et al.

(10) Patent No.: US 9,280,073 B1
(45) Date of Patent: Mar. 8, 2016

(54) IMAGE FORMING APPARATUS AND PROCESS CARTRIDGE

(71) Applicant: FUJI XEROX CO., LTD., Tokyo (JP)

(72) Inventors: Kazuyuki Tada, Kanagawa (JP); Shinya Makiura, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/830,122

(22) Filed: Aug. 19, 2015

(30) Foreign Application Priority Data

Mar. 18, 2015 (JP) ..... 2015-055042

(51) Int. Cl.
*G03G 5/00* (2006.01)
*G03G 7/00* (2006.01)

(52) U.S. Cl.
CPC ..... *G03G 7/0073* (2013.01)

(58) Field of Classification Search
CPC ..... G03G 7/0073
See application file for complete search history.

(56) References Cited

U.S. PATENT DOCUMENTS 7,232,635 B2 6/2007 Kobayashi et al.
7,517,629 B2 4/2009 Kobayashi et al.

FOREIGN PATENT DOCUMENTS

JP H07-287435 A 10/1995
JP H08-286393 A 11/1996
JP H11-160899 A 6/1999
JP 2004-157315 A 6/2004
JP 2004-157316 A 6/2004
JP 2007-121887 A 5/2007
JP 4134576 B2 8/2008
JP 4134698 B2 8/2008
JP 4134699 B2 8/2008

*Primary Examiner* — G. M. Hyder
(74) *Attorney, Agent, or Firm* — Oliff PLC

(57) ABSTRACT

An image forming apparatus includes an electrophotographic photoreceptor that includes a conductive substrate and an organic layer which includes a photoreceptive layer; a charging member that charges the surface of the electrophotographic photoreceptor; an electrostatic latent image forming unit; a developing unit; a transfer unit; and a cleaning member that performs cleaning on the surface of the electrophotographic photoreceptor, wherein a contact area of the electrophotographic photoreceptor with the cleaning member in an axis direction of the electrophotographic photoreceptor is wider than a contact area thereof with the charging member, and d, d', d" and d"max, which each are values with respect to the total film thickness of the organic layer at the respective portions as defined in the present specification, satisfy expressions $0.97 \leq d'/d \leq 1.03$, $0.97 \leq d''/d \leq 1.1$ and $1.03 \leq d''max/d \leq 1.1$ at each of both of the end portions in the axis direction of the electrophotographic photoreceptor.

12 Claims, 5 Drawing Sheets

IMAGE FORMING APPARATUS AND PROCESS CARTRIDGE

CROSS-REFERENCE TO RELATED APPLICATIONS

This application is based on and claims priority under 35 USC 119 from Japanese Patent Application No. 2015-055042 filed Mar. 18, 2015.

BACKGROUND

1. Technical Field

The present invention relates to an image forming apparatus and a process cartridge.

2. Related Art

An electrophotographic type image forming apparatus generally includes an electrophotographic photoreceptor (which may be described as a "photoreceptor"), a charging unit, an electrostatic latent image forming unit, a developing unit, a transfer unit, a cleaning unit, a fixing unit, and the like.

SUMMARY

According to an aspect of the invention, there is provided an image forming apparatus including:

an electrophotographic photoreceptor that includes a conductive substrate and an organic layer which is provided on the conductive substrate and includes at least a photoreceptive layer;

a charging member that contacts with a surface of the electrophotographic photoreceptor and charges the surface of the electrophotographic photoreceptor;

an electrostatic latent image forming unit that forms an electrostatic latent image on the surface of the electrophotographic photoreceptor;

a developing unit that develops the electrostatic latent image which is formed on the surface of the electrophotographic photoreceptor by using a developer containing a toner, to form a toner image;

a transfer unit that transfers the toner image to a surface of a recording medium; and a cleaning member that contacts with the surface of the electrophotographic photoreceptor so as to perform cleaning on the surface of the electrophotographic photoreceptor, wherein a contact area of the electrophotographic photoreceptor and the cleaning member in an axis direction of the electrophotographic photoreceptor is wider than a contact area of the electrophotographic photoreceptor and the charging member, maximum total film thickness portions at each of both end portions in the axis direction of the electrophotographic photoreceptor, at which a total film thickness of the organic layer becomes the greatest are included at a non-contact area with the cleaning member, and when an average of the total film thickness of the organic layer in a contact area with the charging member is set as d, the total film thickness of the organic layer in a non-contact area with the charging member and in an area A from an end portion of the contact area with the charging member to an end portion of the contact area with the cleaning member in the axis direction of the electrophotographic photoreceptor is set as d', the total film thickness of the organic layer in the non-contact area with the cleaning member and in an area B from the end portion of the contact area with the cleaning member in the axis direction of the electrophotographic photoreceptor to the maximum total film thickness portion is set as d", and the total film thickness of the maximum total film thickness portion of the organic layer is set as d"max, all the following relational expressions (1) to (3) are satisfied at each of both of the end portions in the axis direction of the electrophotographic photoreceptor;

$$0.97 \leq d'/d \leq 1.03 \quad (1)$$

$$0.97 \leq d''/d \leq 1.1 \quad (2)$$

$$1.03 \leq d''\mathrm{max}/d \leq 1.1 \quad (3).$$

BRIEF DESCRIPTION OF THE DRAWINGS

Exemplary embodiments of the present invention will be described in detail based on the following figures, wherein.

DETAILED DESCRIPTION

Figure 1:
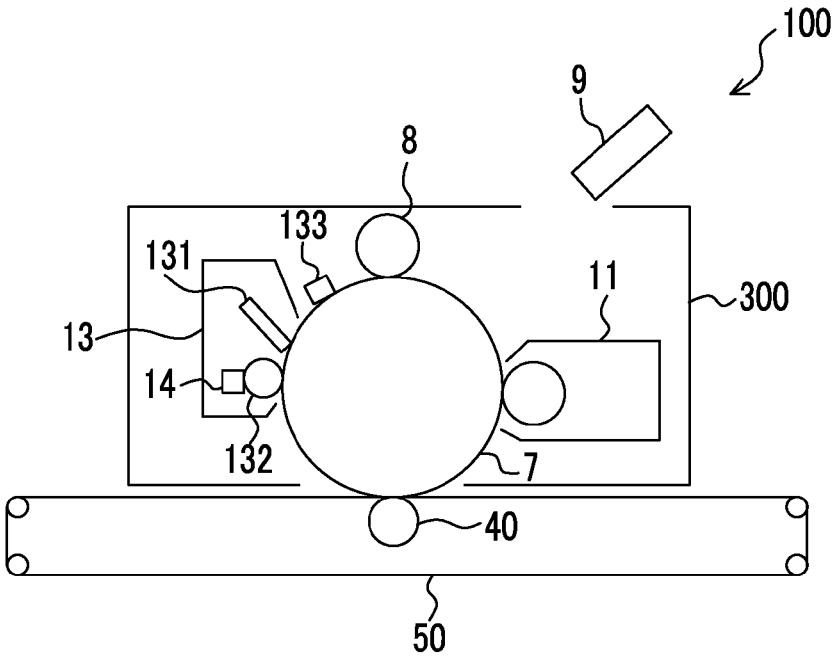
FIG. 1 is a schematic configuration diagram illustrating an example of an image forming apparatus according to the exemplary embodiment.

Hereinafter, an image forming apparatus according to the exemplary embodiment will be described in detail.

The image forming apparatus according to the exemplary embodiment includes an electrophotographic photoreceptor, a charging member, an electrostatic latent image forming unit, a developing unit, a transfer unit, and a cleaning member. The electrophotographic photoreceptor includes a conductive substrate and an organic layer which is provided on the conductive substrate and includes at least a photoreceptive layer. The charging member contacts with a surface of the electrophotographic photoreceptor and charges the surface of the electrophotographic photoreceptor. The electrostatic latent image forming unit forms an electrostatic latent image on the surface of the electrophotographic photoreceptor. The developing unit develops the electrostatic latent image which is formed on the surface of the electrophotographic photoreceptor by using a developer containing a toner, so as to form a toner image. The transfer unit transfers the toner image to a surface of a recording medium. The cleaning member contacts with the surface of the electrophotographic photoreceptor so as to perform cleaning on the surface of the electrophotographic photoreceptor. A contact area of the electrophotographic photoreceptor and the cleaning member in an axis direction of the electrophotographic photoreceptor is wider than a contact area of the electrophotographic photoreceptor and the charging member. The maximum total film thickness portions at both end portions in the axis direction of the electrophotographic photoreceptor, at which the total film thickness of the organic layer becomes the greatest are included at a non-contact area with the cleaning member. When an average of the total film thickness of the organic layer in a contact area with the charging member is set as d, a total film thickness of the organic layer in a non-contact area with the charging member and in an area A from an end portion of the contact area with the charging member to an end portion of the contact area with the cleaning member in the axis direction of the electrophotographic photoreceptor is set as d', the total film thickness of the organic layer in a non-contact area with the cleaning member and in an area B from an end portion of the contact area with the cleaning member in the axis direction of the electrophotographic photoreceptor to the maximum total film thickness portion is set as d", and the total film thickness of the maximum total film thickness portion of the organic layer is set as d"max, all the following relational expressions (1) to (3) are satisfied at both of the end portions in the axis direction of the electrophotographic photoreceptor.

$$0.97 \leq d'/d \leq 1.03 \quad (1)$$

$$0.97 \leq d''/d \leq 1.1 \quad (2)$$

$$1.03 \leq d''\text{max}/d \leq 1.1 \quad (3)$$

A reason that occurrence of dielectric breakdown is prevented at the end portion in the axis direction of the photoreceptor in the image forming apparatus according to the exemplary embodiment is supposed as follows.

A contact charging method in which the charging member such as a charging roll contacts with the surface of the electrophotographic photoreceptor so as to charge the surface of the photoreceptor has a lower voltage and a smaller ozone generation than a non-contact charging method using a corona discharger. However, since the charging member contacts with the surface of the photoreceptor, an amount of chipping the surface layer of the photoreceptor becomes significant during repetitive image forming, and particularly, wear (uneven wear) which is biased at the end portion, not at the center portion in the axis direction of the photoreceptor occurs easily, and consequently peeling of the layer or dielectric breakdown may occur.

As the electrophotographic photoreceptor, an organic photoreceptor is mainly used, and mainly prepared by using a dipping coating method from the viewpoint of convenience, high quality, and high productivity. The organic photoreceptor forms a photoreceptive layer and the like by using a coating liquid. The coating liquid contains a material in accordance with a function required by each layer on the conductive substrate, a binder resin, a solvent, and the like.

However, in the dipping coating method, a coating film on a coating start side (upper end side) theoretically flows down due to the gravity and thus becomes thin. In addition, since a intensity of current at that portion becomes greater as a portion of the photoreceptive layer becomes thinner, wear occurs more easily than at a thick film portion. Since a thin film originally has a small wear margin, peeling of the layer or dielectric breakdown easily occurs on the upper end side (coating start side) of the photoreceptor in the image forming apparatus employing the contact charging method.

As a result of close observation of inventors, only definition of the charged area and the film thickness of the organic layer of the photoreceptor is insufficient for countermeasures for prevention of the occurrence of dielectric breakdown due to uneven wear at both end portions in the axis direction of the photoreceptor, and thus the film thickness of the organic layer of the photoreceptor, which includes the contact area with the cleaning member, is required to be appropriately defined. Specifically, if a residual toner adheres to an end portion of a cleaning blade (which may be referred below to as a blade) which is provided as the cleaning member in the image forming apparatus, and is transferred to the photoreceptor along a circumferential direction of the photoreceptor, a toner (which may be referred below to as a "toner stripe") which adheres so as to have a stripe shape is formed at a position corresponding to the vicinity of the end portion of the blade. Particularly, it is considered that if a position of the end portion of the blade is near to a position of an end portion of the charging roll in the axis direction of the photoreceptor, wear of the photoreceptor at the toner stripe portion is promoted, and particularly if the organic layer of the photoreceptor at the toner stripe portion is thin, dielectric breakdown easily occurs.

On the contrary, in the image forming apparatus according to the exemplary embodiment, the contact area of the photoreceptor and the charging member, the contact area of the photoreceptor and the cleaning member, and the total film thickness of the organic layer of the photoreceptor have a specific relationship. Thus, it is considered that uneven wear of the organic layer is prevented, and the occurrence of dielectric breakdown is prevented at the end portion in the axis direction of the photoreceptor.

An example of the image forming apparatus and a process cartridge according to the exemplary embodiment will be described below. However, it is not limited thereto. Main components illustrated in the drawings will be described and descriptions of other components will be omitted. A reference sign regarding members which constitute the image forming apparatus according to the exemplary embodiment may be omitted.

FIG. 1 schematically illustrates an example of a configuration of the image forming apparatus according to the exemplary embodiment.

The image forming apparatus 100 illustrated in FIG. 1 includes an electrophotographic photoreceptor 7, a charging device (one example of a charging unit) 8, an exposure device (one example of an electrostatic latent image forming unit) 9, a transfer device (primary transfer device) 40, an intermediate transfer member 50, and a cleaning device 13 (one example of a cleaning unit).

A process cartridge 300 supports, in a housing, the electrophotographic photoreceptor 7, the charging device 8 (one example of the charging unit), a developing device 11 (one example of the developing unit), and the cleaning device 13 (one example of the cleaning unit) as a unit.

The exposure device 9 is arranged at a position where the exposure device 9 may radiate light onto the electrophotographic photoreceptor 7 through an opening in the process cartridge 300. The transfer device 40 is arranged at a position opposite to the electrophotographic photoreceptor 7 by the intermediary of the intermediate transfer member 50. The intermediate transfer member 50 is arranged to contact partially the electrophotographic photoreceptor 7. Although not shown in the figure, the apparatus also includes a secondary transfer device that transfers a toner image transferred onto the intermediate transfer member 50 to a recording medium (for example, paper). Further, the intermediate transfer member 50, the transfer device 40 (primary transfer device), and the secondary transfer device (not shown) correspond to an example of the transfer unit.

The components of the image forming apparatus according to the exemplary embodiment will be specifically described below. In the following descriptions, a case where a charging roll as the charging member and a cleaning blade as the cleaning member in the contact charging method are included will be described. However, the charging member and the cleaning member in the exemplary embodiment are not limited thereto.

Electrophotographic Photoreceptor

The electrophotographic photoreceptor according to the exemplary embodiment includes a conductive substrate and an organic layer which is provided on the conductive substrate and includes at least a photoreceptive layer.

As the photoreceptive layer, a function separation type photoreceptive layer obtained by stacking a charge generating layer containing a charge generating material and a charge transport layer containing a charge transporting material may be used, or a single layer type photoreceptive layer in which the charge generating material and the charge transporting material are contained in one layer may be used. Examples of the organic layer other than the photoreceptive layer, which is provided on the conductive substrate, include an undercoat layer, an intermediate layer, and a protective layer. The undercoat layer is provided between the conductive substrate and the photoreceptive layer. The intermediate layer is provided between the undercoat layer and the photoreceptive layer. The protective layer is provided on the photoreceptive layer. These organic layers other than the photoreceptive layer may be provided as necessary.

Figure 2:
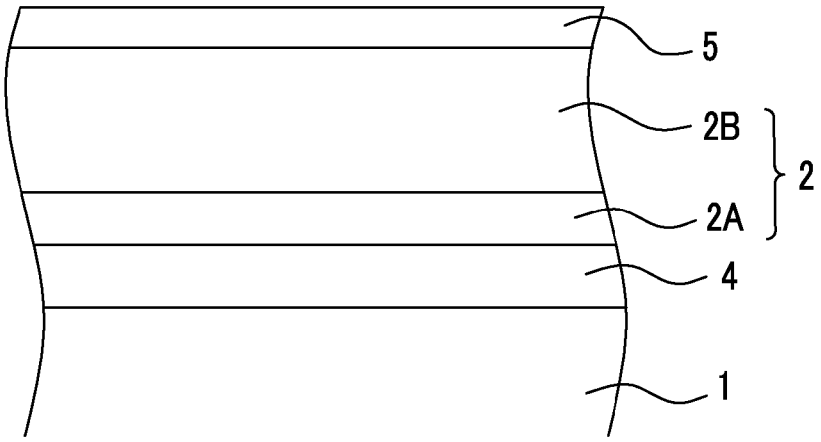
FIG. 2 is a schematic sectional view illustrating an example of a layer structure of an electrophotographic photoreceptor according to the exemplary embodiment.

FIG. 2 schematically illustrates an example of a layer structure of the electrophotographic photoreceptor according to the exemplary embodiment. The electrophotographic photoreceptor illustrated in FIG. 2 has a layer structure in which an undercoat layer 4, a charge generating layer 2A, a charge transport layer 2B, and a protective layer 5 are stacked on a conductive support member 1 in this order. A photoreceptive layer 2 is configured from two layers of the charge generating layer 2A and the charge transport layer 2B.

Figure 3:
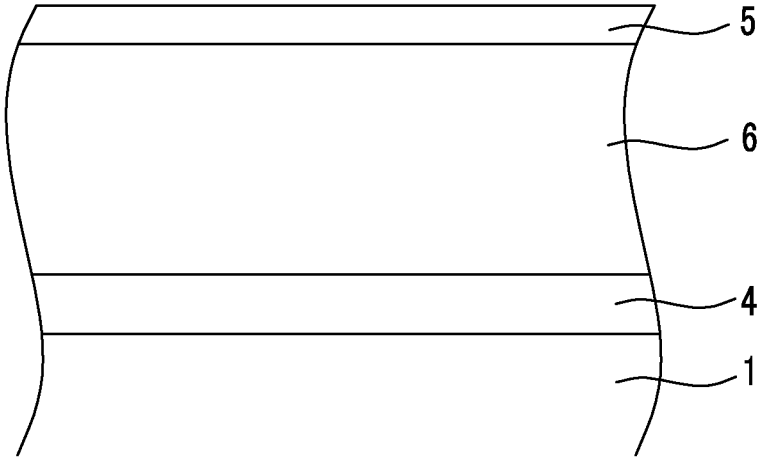
FIG. 3 is a schematic sectional view illustrating another example of a layer structure of the electrophotographic photoreceptor according to the exemplary embodiment.

FIG. 3 schematically illustrates another example of the layer structure of the electrophotographic photoreceptor according to the exemplary embodiment. The electrophotographic photoreceptor illustrated in FIG. 3 has a layer structure in which the undercoat layer 4, a photoreceptive layer 6, and the protective layer 5 are stacked on the conductive support member 1 in this order. The photoreceptive layer 6 of the electrophotographic photoreceptor illustrated in FIG. 3 is a single layer type photoreceptive layer 6 in which functions of the charge generating layer 2A and the charge transport layer 2B illustrated in FIG. 2 are unified.

The electrophotographic photoreceptor according to the exemplary embodiment is not limited to the layer structures illustrated in FIGS. 2 and 3. For example, the electrophotographic photoreceptor may not include the undercoat layer 4 and the protective layer 5, or may include an intermediate layer between the undercoat layer 4 and the photoreceptive layer.

Charging Device

As the charging member 8 in the charging device, for example, a conductive or semiconductive charging roll is used. The image forming apparatus according to the exemplary embodiment is operated by using the contact charging method in which the charging roll contacts with a surface of the electrophotographic photoreceptor 7 and thus charges the surface of the electrophotographic photoreceptor 7.

As the charging roll 8 according to the exemplary embodiment, a well-known charging roll may be used. For example, a roll member which includes a cylindrical or columnar bar member (shaft), and a conductive elastic layer provided on an outer circumference surface of the shaft, and a surface layer provided on an outer circumference surface of the conductive elastic layer may be used.

The charging member 8 in the image forming apparatus according to the exemplary embodiment is not limited to the charging roll, and may include a charging brush, a charging film, a charging rubber blade, a charging tube, and the like, for example.

Exposure Device

The exposure device 9 may be an optical instrument for exposure of the surface of the electrophotographic photoreceptor 7, to rays such as a semiconductor laser ray, an LED ray, and a liquid crystal shutter ray in a predetermined image-wise manner. The wavelength of the light source may be a wavelength in the range of the spectral sensitivity wavelengths of the electrophotographic photoreceptor. As the wavelengths of semiconductor lasers, near infrared wavelengths that are laser-emission wavelengths near 780 nm are predominant. However, the wavelength of the laser ray to be used is not limited to such a wavelength, and a laser having an emission wavelength of 600 nm range, or a laser having any emission wavelength in the range of 400 nm to 450 nm may be used as a blue laser. In order to form a color image, it is effective to use a planar light emission type laser light source capable of attaining a multi-beam output.

Developing Device

As the developing device 11, for example, a common developing device, in which a magnetic or non-magnetic single-component or two-component developer is contacted or not contacted for forming an image, may be used. Such a developing device 11 is not particularly limited as long as it has the above-described functions, and may be appropriately selected according to the intended use. Examples thereof include a known developing device in which the single-component or two-component developer is applied to the electrophotographic photoreceptor 7 using a brush or a roller. Among these, the developing device using developing roller retaining developer on the surface thereof is preferable.

The developer used in the developing device 11 may be a single-component developer formed of a toner singly or a two-component developer formed of a toner and a carrier. Further, the toner may be magnetic or non-magnetic. As the developer, known ones may be applied.

Cleaning Device

The cleaning device 13 has a cleaning blade 131 (one example of the cleaning member) and the cleaning blade 131 is provided to contact with the surface of the electrophotographic photoreceptor 7.

As the cleaning member in the exemplary embodiment, a well-known cleaning blade may be used. The cleaning blade 131 may have a single layer structure or a double-layer structure formed from a base layer and a surface layer which contacts with the electrophotographic photoreceptor 7. A material forming the cleaning blade 131 is desired to be an elastic rubber member formed of polyurethane.

The cleaning member in the exemplary embodiment may be a conductive or insulating fibrous member, besides the embodiment using the cleaning blade 131. As the cleaning member in the exemplary embodiment, only the fibrous member may be used or the cleaning blade 131 as well as the fibrous member for assisting cleaning may be used in combination.

FIG. 1 illustrates an example in which a (roll-shaped) fibrous member 132 for supplying a lubricant 14 onto the surface of the electrophotographic photoreceptor 7, and a (flat brush-shaped) fibrous member 133 for assisting cleaning are included. However, these components may be provided as necessary.

Transfer Device

Examples of transfer device 40 include known transfer charging devices themselves, such as a contact type transfer charging device using a belt, a roller, a film, a rubber blade, or the like, a scorotron transfer charging device, and a corotron transfer charging device utilizing corona discharge.

Intermediate Transfer Member

As the intermediate transfer member 50, a form of a belt which is imparted with the semiconductivity (intermediate transfer belt) of polyimide, polyamideimide, polycarbonate, polyarylate, polyester, rubber, or the like is used. In addition, the intermediate transfer member may also take the form of a drum, in addition to the form of a belt.

Figure 4:
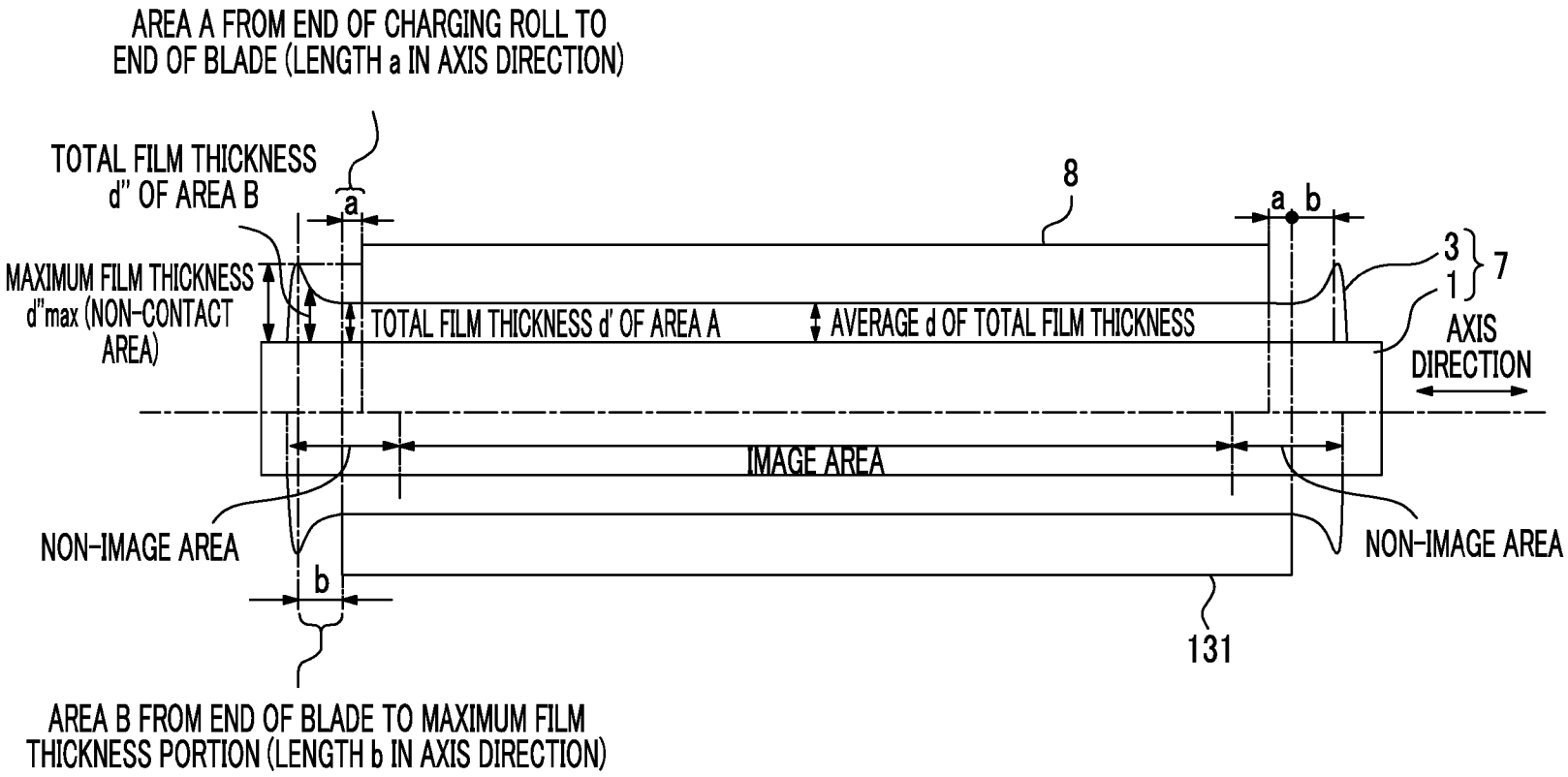
FIG. 4 is a schematic diagram illustrating an exploded view of a film thickness of an organic layer in the electrophotographic photoreceptor, regarding a relationship between the electrophotographic photoreceptor, a charging member, and a cleaning member according to the exemplary embodiment.

FIG. 4 schematically illustrates a relationship between the electrophotographic photoreceptor 7, the charging member (charging roll) 8, and the cleaning member (cleaning blade) 131 in the exemplary embodiment. FIG. 4 illustrates an exploded view of the film thickness of the organic layer in the electrophotographic photoreceptor.

In the image forming apparatus according to the exemplary embodiment, the contact area of the electrophotographic photoreceptor 7 and the cleaning member 131 is wider than the contact area of the electrophotographic photoreceptor 7 and the charging member 8 in the axis direction of the electrophotographic photoreceptor 7. A non-contact area with the cleaning member 131 has a maximum total film thickness portion at which the total film thickness of an organic layer 3 becomes the maximum at each of both end portions of the electrophotographic photoreceptor 7.

A toner image is formed on the surface of the electrophotographic photoreceptor 7 after the contact area with the charging member 8 is charged and an electrostatic latent image is formed by exposure. The toner image is transferred to a recording medium through the intermediate transfer member, or is directly transferred to the recording medium. For example, as illustrated in FIG. 4, since an inner side of the contact area with the charging member 8 becomes an area (image area) in which the toner image is formed, the toner easily remains in the contact area with the charging member 8 on the surface of the electrophotographic photoreceptor 7. In the exemplary embodiment, the cleaning member 131 contacts with the electrophotographic photoreceptor 7 in a wider range in the axis direction than a range in which the charging member 8 contacts with the electrophotographic photoreceptor 7. Thus, the toner remaining on the surface of the electrophotographic photoreceptor 7 is reliably removed.

The electrophotographic photoreceptor in the exemplary embodiment preferably satisfies the following relationships at each of both end portions in the axis direction of the electrophotographic photoreceptor when an area from an end portion of the contact area with the charging member to an end portion of the contact area with the cleaning member in the axis direction of the electrophotographic photoreceptor, the area being the non-contact area with the charging member, is set as an area A, and a length of the area A is set as a.

$$1\ \text{mm} \le a \le 5\ \text{mm}$$

The length a of the area A being equal to or greater than 1 mm causes partial wear due to a toner stripe formed in the vicinity of the end portion of the cleaning member, and discharging at the end portion of the charging member to be prevented. The length a of the area A being equal to or less than 5 mm causes the size of the entirety of the image forming apparatus to be reduced.

From this viewpoint, $1 \le a \le 3$ mm is more preferable.

The non-contact area with the cleaning member 131 has the maximum total film thickness portion at which the total film thickness of the organic layer becomes the maximum at each of both end portions of the electrophotographic photoreceptor, and the total film thickness of the organic layer coming into contact with the cleaning member 131 is substantially constant. Thus, an influence of uneven wear on the surface of the photoreceptor due to concentration of contact pressure at the end portion of the cleaning member 131 is prevented.

The total film thickness of the organic layer 3 refers to a thickness obtained by summing thicknesses of the organic layer 3 which is provided on the conductive substrate and includes at least the photoreceptive layer. The total film thickness of the organic layer 3 is equal to a thickness from the surface of the conductive substrate to a surface of the top surface layer of the electrophotographic photoreceptor in a thickness direction.

For example, in a case of a single layer type photoreceptor having only the single layer type photoreceptive layer as the organic layer, the film thickness of the single layer type photoreceptive layer becomes the total film thickness of the organic layer. For example, in a case of a three-layer structure in which the undercoat layer, the charge generating layer, and the charge transport layer are stacked as the organic layers, the summation of film thicknesses of these three layers becomes the total film thickness of the organic layer. In a case of a four-layer structure in which a protective layer as a top surface layer is stacked on these layers, the summation of film thicknesses of these four layers becomes the total film thickness of the organic layer.

As the film thickness of the organic layer in the electrophotographic photoreceptor according to the exemplary embodiment, a value obtained as follows by using an eddy current film thickness meter (manufactured by FISCHER Corporation) is employed.

As an average value d of the film thickness at the center portion of the organic layer, an average obtained by measuring the center portion, and 12 locations at four positions on each sectional surface, which are separate from the center portion by 80 mm in directions perpendicular to each other (at a 90° interval in the circumferential direction) is employed.

The film thicknesses d' and d" at the end portion of the organic layer are evaluated by performing multipoint measurement in the axis direction of the photoreceptor. Specifically, the end portion of the organic layer is set to 0 mm, and measurement locations are shifted by 1 mm in an axis direction of the substrate. Similarly to the center portion, four locations in directions perpendicular to each other (at a 90° interval in the circumferential direction) on each sectional surface are measured and averaged. Thus, the film thickness at each position in the axis direction is defined. The measured length becomes a distance from the end portion of the organic layer to a contact position of the charging roll.

Here, the "maximum total film thickness portion at which the total film thickness of the organic layer becomes the maximum at each of both end portions in the axis direction of the electrophotographic photoreceptor" means a portion at which the total film thickness of the organic layer becomes the maximum in thickness distribution from the center position to each of end portions in the axis direction of the electrophotographic photoreceptor when the total film thickness of the organic layer in the axis direction is measured regarding an area in which the entirety of the organic layer is stacked in the electrophotographic photoreceptor.

In the image forming apparatus according to the exemplary embodiment, the non-contact area with the cleaning member has the maximum total film thickness portion of the organic layer at both of the end portions in the axis direction of the electrophotographic photoreceptor. However, it is not necessary that thicknesses of the maximum total film thickness portions at both of the end portions are the same as each other. From a viewpoint of preventing uneven wear of the organic layer, a small difference of the thicknesses of the maximum total film thickness portions at both of the end portions is desired.

When a length of an area B from the end portion of the contact area with the cleaning member to the maximum total film thickness portion in the axis direction of the electrophotographic photoreceptor, the area B being in the non-contact area with the cleaning member, is set as b, the following relationship is preferably satisfied at both of the end portions in the axis direction of the electrophotographic photoreceptor.

$$0.1\ \text{mm} \leq b \leq 10\ \text{mm}$$

The length b of the area B being equal to or greater than 0.1 mm may cause promotion of wear of the organic layer to be prevented. The prevention of promotion of wear of the organic layer results from causing an area having the film thickness of the vicinity of the maximum total film thickness portion of the organic layer in the electrophotographic photoreceptor to contact with the cleaning member. The length b of the area B being equal to or less than 10 mm causes the size of the apparatus to be reduced.

From this viewpoint, 0.1 mm≤b≤5 mm is more preferable.

In the image forming apparatus according to the exemplary embodiment, the average of the total film thickness d of the organic layer in the contact area with the charging member, and the total film thickness d' of the organic layer in the area A (which is in the non-contact area with the charging member and is from the end portion of the contact area with the charging member to the end portion of the contact area with the cleaning member in the axis direction of the electrophotographic photoreceptor) satisfy the following relational expression (1).

$$0.97 \leq d'/d \leq 1.03 \quad (1)$$

That is, the total film thickness d' of the organic layer of the electrophotographic photoreceptor in the area A is in a range of ±3% of the average of the total film thickness d of the organic layer of the electrophotographic photoreceptor in the contact area with the charging member. Thus, an outer circumferential surface of the electrophotographic photoreceptor becomes smooth in the entirety of the contact area with the cleaning member and occurrence of locally abnormal wear is prevented.

From this viewpoint, 0.98≤d'/d≤1.02 is preferable.

The average of the total film thickness d of the organic layer of the electrophotographic photoreceptor in the contact area with the charging member varies depending on the layer structure. However, from a viewpoint of prevention of non-uniform charge, the total film thickness of the organic layer of the electrophotographic photoreceptor in the contact area with the charging member is preferably in a range of ±5% in both of the axis direction and the circumferential direction, and more preferably in a range of ±3%.

In the image forming apparatus according to the exemplary embodiment, the average of the total film thickness d of the organic layer of the electrophotographic photoreceptor in the contact area with the charging member, and the total film thickness d" of the organic layer in the area B (which is in the non-contact area with the cleaning member and is from the end portion of the contact area with the cleaning member to the maximum total film thickness portion in the axis direction of the electrophotographic photoreceptor) satisfy the following relational expression (2).

$$0.97 \leq d''/d \leq 1.1 \quad (2)$$

That is, the total film thickness d" of the organic layer of the electrophotographic photoreceptor in the area B is in a range of from −3% to +10% of the average of the total film thickness d of the organic layer of the electrophotographic photoreceptor in the contact area with the charging member. Thus, the total film thickness d" of the organic layer of the electrophotographic photoreceptor in the area B is not less than the average of the total film thickness d in a range including variation, and occurrence of a fragment of the cleaning member or an influence of wear at the end portion is prevented.

From this viewpoint, 0.98≤d"/d≤1.05 is preferable.

The average of the total film thickness d of the organic layer of the electrophotographic photoreceptor in the contact area with the charging member, and the total film thickness d"max at the maximum total film thickness portion in the organic layer satisfy the following relational expression (3).

$$1.03 \leq d''\text{max}/d \leq 1.1 \quad (3)$$

That is, the total film thickness d"max at the maximum total film thickness portion in the organic layer of the electrophotographic photoreceptor is in a range of from +3% to +10% of the average of the total film thickness d of the organic layer of the electrophotographic photoreceptor in the contact area with the charging member. Thus, drastic change of the organic layer in the electrophotographic photoreceptor is prevented in the area A and the area B, and occurrence of a fragment of the cleaning member or wear at the end portion is prevented in the area A.

From this viewpoint, 1.03≤d"max/d≤1.05 is preferable.

Film Forming Method of Organic Layer

A film forming method of the organic layer of the electrophotographic photoreceptor in the exemplary embodiment is not particularly limited as long as the end portion (non-image area) being the non-contact area with the cleaning member has the maximum total film thickness portion at which the total film thickness of the organic layer at each of both of the end portions in the axis direction of the electrophotographic photoreceptor becomes the maximum, and the total film thickness of the organic layer satisfies all of the relational expressions (1) to (3).

A method in which a coating liquid for forming each organic layer is applied on the conductive substrate, dried so as to perform sequential formation is included. For example, when one end portion of the cylindrical conductive substrate is set as an upper end, and the other end portion thereof is set as a lower end, and thus each organic layer is formed as a film by using the dipping coating method, the film thickness easily becomes thin at the upper end portion and the film thickness easily becomes thick at the lower end portion. Particularly, it is difficult to form the maximum total film thickness portion of the organic layer in the non-contact area with the cleaning member on the upper end portion side.

As a method of applying the coating liquid for forming each organic layer, in the exemplary embodiment, from a viewpoint of controlling the film thickness of each organic layer with high accuracy, methods of an ink jet method, a beam coating method, a nozzle coating method, and the like are included. In addition, a method in which a coating liquid for forming each organic layer is ejected by using the ink jet method, the beam coating method, or the nozzle coating method, so as to perform sequential coating from one end portion of the rotating conductive substrate to the other end portion is appropriate.

When the organic layer such as the photoreceptive layer is formed as a film on the conductive substrate, pattern film formation may be performed with adjusting of an ejecting amount (flow rate) per unit time at both of the end portions in the axis direction, for the center portion (image area) formed as the contact area with the charging member under a predetermined condition such that the relational expressions (1) to (3) are satisfied. Specifically, delaying a head moving speed at both of the end portions at a constant flow rate, increasing the flow rate at both of the end portions at a constant head moving speed, and the like are included.

For example, when the single layer type photoreceptor which includes only the photoreceptive layer as the organic layer on the conductive substrate is prepared, the thickness of the photoreceptive layer is adjusted.

In a function separation type photoreceptor including a function separation type photoreceptive layer in which the charge generating layer and the charge transport layer are stacked, the film thickness of the charge generating layer is normally much smaller than the film thickness of the charge transport layer, and is much smaller than the thickness of the undercoat layer or the protective layer which is formed as necessary. For this reason, for example, as illustrated in FIG. 3, in the function separation type electrophotographic photoreceptor in which the undercoat layer, the charge generating layer, the charge transport layer, and the protective layer are sequentially stacked on the conductive substrate, the total film thickness of the organic layer is approximate to the summation of the film thicknesses of the undercoat layer, the charge transport layer, and the protective layer. The total film thickness of the organic layer may be adjusted by adjusting the thickness of one layer or thicknesses of two layers or more among the undercoat layer, the charge transport layer, and the protective layer.

Figure 5:
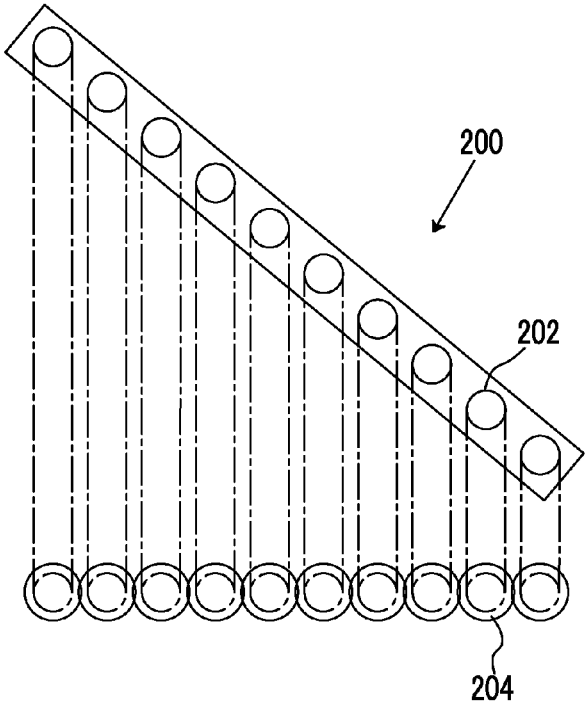
FIG. 5 is a schematic diagram illustrating a state where some of liquid drops which are ejected from a liquid drop ejecting head and hit by using an ink jet method are overlapped.
Figure 6:
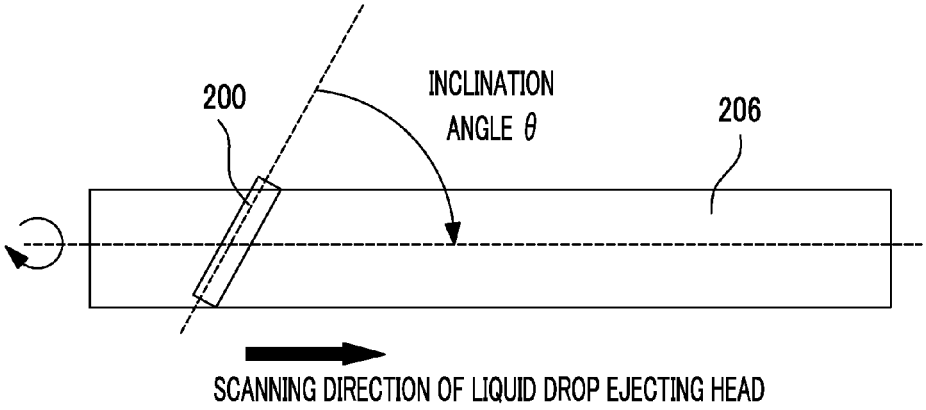
FIG. 6 is a schematic diagram illustrating a slope (inclination angle θ) of the liquid drop ejecting head that applies a coating liquid onto a cylindrical object to be coated by using the ink jet method.

FIGS. 5 and 6 schematically illustrate an example of a method of performing coating using the ink jet method. A liquid drop ejecting head 200 is installed so as to be inclined to an axis of the cylindrical conductive substrate, as illustrated in FIG. 6 such that adjacent liquid drops 204 after the liquid drops 204 are ejected from nozzles 202 and come into contact with each other instantly on the surface of the conductive substrate, as illustrated in FIG. 5. As illustrated in FIG. 5, the diameter of the liquid drop at a time of ejecting is substantially the diameter of the nozzle as indicated by a dot line. However, the diameter of the liquid drop after the drop is impinged and wetted on the surface of the conductive substrate 206, becomes greater as indicated by a solid line. Thus, adjacent liquid drops come into contact with each other, and thus a coating film is formed.

Specifically, the conductive substrate 206 is mounted on an apparatus which performs horizontal rotation, and the liquid drop ejecting head 200 filled with the coating liquid is provided such that liquid drops are ejected on the conductive substrate 206. In this state, the conductive substrate 206 is rotated, and the coating liquid is ejected from the nozzles 202. As illustrated in FIG. 6, the liquid drop ejecting head 200 is moved horizontally from one end portion of the conductive substrate 206 to the end portion thereof on an opposite side. For example, in the ink jet method using such a liquid drop ejecting head 200, the thickness and the evenness of the coating film are adjusted by using a solid content concentration in the coating liquid, an ejecting amount from the liquid drop ejecting head per unit time, an inclination angle (θ) of the liquid drop ejecting head to an axis direction of the conductive substrate, a movement speed of the liquid drop ejecting head, a rotation speed of the conductive substrate, and the like.

As ejecting techniques in the ink jet method, general techniques such as a continuous type, an intermittent type (piezoelectric type (piezoelectric element), a thermal type, an electrostatic type, and the like) are used. However, the continuous type and the intermittent type using a piezoelectric element are desired. From a viewpoint of productivity and ejecting stability, the continuous type is more desired.

After coating, curing is performed by performing heating and drying, and thereby an organic layer is formed.

When, for example, a monomer polymerized by heat is used as a material being a component constituting the organic layer, the monomer is polymerized, a solvent is removed by heating, and thereby the cured organic layer is formed. A heating temperature in this case may be selected in accordance with types of the monomer, the boiling point of the solvent, and the like.

An electrophotographic photoreceptor having the layer structure illustrated in FIG. 3 will be described as an example for the electrophotographic photoreceptor according to the exemplary embodiment.

Conductive Substrate

Examples of the conductive substrate include metal plates, metal drums, and metal belts using metals (such as aluminum, copper, zinc, chromium, nickel, molybdenum, vanadium, indium, gold, and platinum), and alloys thereof (such as stainless steel). Further, other examples of the conductive substrate include papers, resin films, and belts which are coated, deposited, or laminated with a conductive compound (such as a conductive polymer and indium oxide), a metal (such as aluminum, palladium, and gold), or alloys thereof. The term "conductive" means that the volume resistivity is less than $10^{13}$ Ωcm.

When the electrophotographic photoreceptor is used in a laser printer, the surface of the conductive substrate is preferably roughened so as to have a centerline average roughness (Ra) of 0.04 μm to 0.5 μm sequentially to prevent interference fringes which are formed when irradiated by laser light. Further, when an incoherent light is used as a light source, surface roughening for preventing interference fringes is not particularly necessary, but occurrence of defects due to the irregularities on the surface of the conductive substrate is prevented, which is thus suitable for achieving a longer service life.

As the method for surface roughening, wet honing in which an abrasive is suspended in water and sprayed onto the support member, centerless grinding in which the conductive substrate is pressed on a rotating whetstone and grinding is continuously performed, an anodic oxidation treatment, and the like are included.

Other examples of the method for surface roughening include a method for surface roughening by forming a layer of a resin in which conductive or semiconductive particles are dispersed on the surface of a conductive substrate so that the surface roughening is achieved by the particles dispersed in the layer, without roughing the surface of the conductive substrate.

In the surface roughening treatment by anodic oxidation, an oxide film is formed on the surface of a conductive substrate by anodic oxidation in which a metal (for example, aluminum) conductive substrate as an anode is anodized in an electrolyte solution. Examples of the electrolyte solution include a sulfuric acid solution and an oxalic acid solution. However, the porous anodic oxide film formed by anodic oxidation without modification is chemically active, easily contaminated and has a large resistance variation depending on the environment. Therefore, it is preferable to conduct a sealing treatment in which fine pores of the anodic oxide film are sealed by cubical expansion caused by a hydration in pressurized water vapor or boiled water (to which a metallic salt such as a nickel salt may be added) to transform the anodic oxide into a more stable hydrated oxide.

The film thickness of the anodic oxide film is preferably from 0.3 μm to 15 μm. When the thickness of the anodic oxide film is within the above range, a barrier property against injection tends to be exerted and an increase in the residual potential due to the repeated use tends to be prevented.

The conductive substrate may be subjected to a treatment with an acidic aqueous solution or a boehmite treatment.

The treatment with an acidic treatment solution is carried out as follows. First, an acidic treatment solution including phosphoric acid, chromic acid, and hydrofluoric acid is prepared. The mixing ratio of phosphoric acid, chromic acid, and hydrofluoric acid in the acidic treatment solution is, for example, from 10% by weight to 11% by weight of phosphoric acid, from 3% by weight to 5% by weight of chromic acid, and from 0.5% by weight to 2% by weight of hydrofluoric acid. The concentration of the total acid components is preferably in the range of 13.5% by weight to 18% by weight. The treatment temperature is, for example, preferably from 42° C. to 48° C. The film thickness of the film is preferably from 0.3 μm to 15 μm.

The boehmite treatment is carried out by immersing the substrate in pure water at a temperature of 90° C. to 100° C. for 5 minutes to 60 minutes, or by bringing it into contact with heated water vapor at a temperature of 90° C. to 120° C. for 5 minutes to 60 minutes. The film thickness is preferably from 0.1 μm to 5 μm. The film may further be subjected to an anodic oxidation treatment using an electrolyte solution which sparingly dissolves the film, such as adipic acid, boric acid, borate, phosphate, phthalate, maleate, benzoate, tartrate, and citrate solutions.

Undercoat Layer

The undercoat layer is, for example, a layer including inorganic particles and a binder resin.

Examples of the inorganic particles include inorganic particles having powder resistance (volume resistivity) of about $10^2$ Ωcm to $10^{11}$ Ωcm.

Among these, as the inorganic particles having the resistance values above, metal oxide particles such as tin oxide particles, titanium oxide particles, zinc oxide particles, and zirconium oxide particles are preferable, and zinc oxide particles are more preferable.

The specific surface area of the inorganic particles as measured by a BET method is, for example, preferably 10 $m^2/g$ or more.

The volume average particle diameter of the inorganic particles is, for example, preferably from 50 nm to 2,000 nm (preferably from 60 nm to 1,000 nm).

The content of the inorganic particles is, for example, preferably from 10% by weight to 80% by weight, and more preferably from 40% by weight to 80% by weight, based on the binder resin.

The inorganic particles may be the ones which have been subjected to a surface treatment. The inorganic particles which have been subjected to different surface treatments or have different particle diameters may be used in combination of two or more kinds.

Examples of the surface treatment agent include a silane coupling agent, a titanate coupling agent, an aluminum coupling agent, and a surfactant. Particularly, the silane coupling agent is preferable, and a silane coupling agent having an amino group is more preferable.

Examples of the silane coupling agent having an amino group include 3-aminopropyltriethoxysilane, N-2-(aminoethyl)-3-aminopropyltrimethoxysilane, N-2-(aminoethyl)-3-aminopropylmethyldimethoxysilane, and N,N-bis(2-hydroxyethyl)-3-aminopropyltriethoxysilane, but are not limited thereto.

These silane coupling agents may be used as a mixture of two or more kinds thereof. For example, a silane coupling agent having an amino group and another silane coupling agent may be used in combination. Other examples of the silane coupling agent include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane, but are not limited thereto.

The surface treatment method using a surface treatment agent may be any one of known methods, and may be either a dry method or a wet method.

The amount of the surface treatment agent for treatment is, for example, preferably from 0.5% by weight to 10% by weight, based on the inorganic particles.

Here, inorganic particles and an electron acceptive compound (acceptor compound) are preferably included in the undercoat layer from the viewpoint of superior long-term stability of electrical characteristics and carrier blocking property.

Examples of the electron acceptive compound include electron transporting materials such as quinone compounds such as chloranil and bromanil; tetracyanoquinodimethane compounds; fluorenone compounds such as 2,4,7-trinitrofluorenone and 2,4,5,7-tetranitro-9-fluorenone; oxadiazole compounds such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole; xanthone compounds; thiophene compounds; and diphenoquinone compounds such as 3,3',5,5'-tetra-t-butyldiphenoquinone.

Particularly, as the electron acceptive compound, compounds having an anthraquinone structure are preferable. As the electron acceptive compounds having an anthraquinone structure, hydroxyanthraquinone compounds, aminoanthraquinone compounds, aminohydroxyanthraquinone compounds, and the like are preferable, and specifically, anthraquinone, alizarin, quinizarin, anthrarufin, purpurin, and the like are preferable.

The electron acceptive compound may be included as dispersed with the inorganic particles in the undercoat layer, or may be included as attached to the surface of the inorganic particles.

Examples of the method of attaching the electron acceptive compound to the surface of the inorganic particles include a dry method and a wet method.

The dry method is a method for attaching an electron acceptive compound to the surface of the inorganic particles, in which the electron acceptive compound is added dropwise to the inorganic particles or sprayed thereto together with dry air or nitrogen gas, either directly or in the form of a solution in which the electron acceptive compound is dissolved in an organic solvent, while the inorganic particles are stirred with a mixer or the like having a high shearing force. The addition or spraying of the electron acceptive compound is preferably carried out at a temperature no higher than the boiling point of the solvent. After the addition or spraying of the electron acceptive compound, the inorganic particles may further be subjected to baking at a temperature of 100° C. or higher. The baking may be carried out at any temperature and timing without limitation, by which desired electrophotographic characteristics may be obtained.

The wet method is a method for attaching an electron acceptive compound to the surface of the inorganic particles, in which the inorganic particles are dispersed in a solvent by means of stirring, ultrasonic wave, a sand mill, an attritor, a ball mill, or the like, then the electron acceptive compound is added and the mixture is further stirred or dispersed, and thereafter, the solvent is removed. As a method for removing the solvent, the solvent is removed by filtration or distillation. After removing the solvent, the particles may further be subjected to baking at a temperature of 100° C. or higher. The baking may be carried out at any temperature and timing without limitation, in which desired electrophotographic characteristics may be obtained. In the wet method, the moisture contained in the inorganic particles may be removed prior to adding the surface treatment agent, and examples of a method for removing the moisture include a method for removing the moisture by stirring and heating the inorganic particles in a solvent or by azeotropic removal with the solvent.

Furthermore, the attachment of the electron acceptive compound may be carried out before or after the inorganic particles are subjected to a surface treatment using a surface treatment agent, and the attachment of the electron acceptive compound may be carried out at the same time with the surface treatment using a surface treatment agent.

The content of the electron acceptive compound is, for example, preferably from 0.01% by weight to 20% by weight, and more preferably from 0.01% by weight to 10% by weight, based on the inorganic particles.

Examples of the binder resin used in the undercoat layer include known materials, such as well-known polymeric compounds such as acetal resins (for example, polyvinylbutyral), polyvinyl alcohol resins, polyvinyl acetal resins, casein resins, polyamide resins, cellulose resins, gelatins, polyurethane resins, polyester resins, unsaturated polyester resins, methacrylic resins, acrylic resins, polyvinyl chloride resins, polyvinyl acetate resins, vinyl chloride-vinyl acetate-maleic anhydride resins, silicone resins, silicone-alkyd resins, urea resins, phenol resins, phenol-formaldehyde resins, melamine resins, urethane resins, alkyd resins, and epoxy resins; zirconium chelate compounds; titanium chelate compounds; aluminum chelate compounds; titaniumalkoxide compounds; organic titanium compounds; and silane coupling agents.

Other examples of the binder resin used in the undercoat layer include charge transporting resins having charge transporting groups, and conductive resins (for example, polyaniline).

Among these, as the binder resin used in the undercoat layer, a resin which is insoluble in a coating solvent of an upper layer is suitable, and particularly, resins obtained by reacting thermosetting resins such as urea resins, phenol resins, phenol-formaldehyde resins, melamine resins, urethane resins, unsaturated polyester resins, alkyd resins, and epoxy resins; and resins obtained by a reaction of a curing agent and at least one kind of resin selected from the group consisting of polyamide resins, polyester resins, polyether resins, methacrylic resins, acrylic resins, polyvinyl alcohol resins, and polyvinyl acetal resins with curing agents are suitable.

In the case where these binder resins are used in combination of two or more kinds thereof, the mixing ratio is set as appropriate.

Various additives may be used for the undercoat layer to improve electrical characteristics, environmental stability, or image quality.

Examples of the additives include known materials such as the polycyclic condensed type or azo type of the electron transporting pigments, zirconium chelate compounds, titanium chelate compounds, aluminum chelate compounds, titanium alkoxide compounds, organic titanium compounds, and silane coupling agents. A silane coupling agent, which is used for surface treatment of inorganic particles as described above, may also be added to the undercoat layer as an additive.

Examples of the silane coupling agent as an additive include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethylmethoxysilane, N,N-bis(2-hydroxyethyl)-3-aminopropyltriethoxysilane, and 3-chloropropyltrimethoxysilane.

Examples of the zirconium chelate compounds include zirconium butoxide, zirconium ethylacetoacetate, zirconium triethanolamine, acetylacetonate zirconium butoxide, ethylacetoacetate zirconium butoxide, zirconium acetate, zirconium oxalate, zirconium lactate, zirconium phosphonate, zirconium octanoate, zirconium naphthenate, zirconium laurate, zirconium stearate, zirconium isostearate, methacrylate zirconium butoxide, stearate zirconium butoxide, and isostearate zirconium butoxide.

Examples of the titanium chelate compounds include tetraisopropyl titanate, tetranormalbutyl titanate, butyl titanate dimer, tetra(2-ethylhexyl) titanate, titanium acetyl acetonate, polytitaniumacetyl acetonate, titanium octylene glycolate, titanium lactate ammonium salt, titanium lactate, titanium lactate ethyl ester, titanium triethanol aminate, and polyhydroxy titanium stearate.

Examples of the aluminum chelate compounds include aluminum isopropylate, monobutoxy aluminum diisopropylate, aluminum butylate, diethylacetoacetate aluminum diisopropylate, and aluminum tris(ethylacetoacetate).

These additives may be used singly, or as a mixture or a polycondensate of two or more kinds thereof.

The Vickers hardness of the undercoat layer is preferably 35 or more.

The surface roughness of the undercoat layer (ten point height of irregularities) is adjusted in the range of from $(1/4)n\lambda$ to $(1/2)\lambda$, in which $\lambda$ represents the wavelength of the laser for exposure and n represents a refractive index of the upper layer, in order to prevent a moire image.

Resin particles and the like may be added in the undercoat layer in order to adjust the surface roughness. Examples of the resin particles include silicone resin particles and crosslinked polymethyl methacrylate resin particles. In addition, the surface of the undercoat layer may be polished in order to adjust the surface roughness. Examples of the polishing method include buffing polishing, a sandblasting treatment, wet honing, and a grinding treatment.

The formation of the undercoat layer is not particularly limited, and well-known forming methods are used. However, the formation of the undercoat layer is carried out by, for example, forming a coating film of a coating liquid for forming an undercoat layer, the coating liquid obtained by adding the components above to a solvent, and drying the coating film, followed by heating, as desired.

Examples of the solvent for forming the coating liquid for forming the undercoat layer include alcohol solvents, aromatic hydrocarbon solvents, hydrocarbon halide solvents, ketone solvents, ketone alcohol solvents, ether solvents, and ester solvents.

Examples of these solvents include ordinary organic solvents such as methanol, ethanol, n-propanol, iso-propanol, n-butanol, benzyl alcohol, methyl cellosolve, ethyl cellosolve, acetone, methyl ethyl ketone, cyclohexanone, methyl acetate, ethyl acetate, n-butyl acetate, dioxane, tetrahydrofuran, methylene chloride, chloroform, chlorobenzene, and toluene.

Examples of a method for dispersing inorganic particles in preparing the coating liquid for forming an undercoat layer include known methods such as methods using a roll mill, a ball mill, a vibration ball mill, an attritor, a sand mill, a colloid mill, a paint shaker, and the like.

The film thickness of the undercoat layer is set to a range of, for example, preferably 15 μm or more, and more preferably from 20 μm to 50 μm.

Intermediate Layer

Although not shown in the figures, an intermediate layer may be provided between the undercoat layer and the photosensitive layer.

The intermediate layer is, for example, a layer including a resin. Examples of the resin used in the intermediate layer include polymeric compounds such as acetal resins (for example polyvinylbutyral), polyvinyl alcohol resins, polyvinyl acetal resins, casein resins, polyamide resins, cellulose resins, gelatins, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol-formaldehyde resins, and melamine resins.

The intermediate layer may be a layer including an organic metal compound. Examples of the organic metal compound used in the intermediate layer include organic metal compounds containing a metal atom such as zirconium, titanium, aluminum, manganese, and silicon.

These compounds used in the intermediate layer may be used singly or as a mixture or a polycondensate of plural compounds.

Among these, layers containing organometallic compounds containing a zirconium atom or a silicon atom are preferable.

The formation of the intermediate layer is not particularly limited, and well-known forming methods are used. However, the formation of the intermediate layer is carried out, for example, by forming a coating film of a coating liquid for forming an intermediate layer, the coating liquid obtained by adding the components above to a solvent, and drying the coating film, followed by heating, as desired.

As a coating method for forming an intermediate layer, ordinary methods such as a dipping coating method, an extrusion coating method, a wire bar coating method, a spraying method, a blade coating method, a knife coating method, and a curtain coating method are used.

The film thickness of the intermediate layer is set to, for example, preferably from 0.1 μm to 3 μm. Further, the intermediate layer may be used as an undercoat layer.

Charge Generating Layer

The charge generating layer is, for example, a layer including a charge generating material and a binder resin. Further, the charge generating layer may be a layer in which a charge generating material is deposited. The layer in which the charge generating material is deposited is suitable for a case where a non-interfering light source such as a light emitting diode (LED) and an organic electro-luminescence (EL) image array.

Examples of the charge generating material include azo pigments such as bisazo and trisazo pigments; condensed aromatic pigments such as dibromoanthanthrone pigments; perylene pigments; pyrrolopyrrole pigments; phthalocyanine pigments; zinc oxides; and trigonal selenium.

Among these, in order to corresponding to laser exposure in the near-infrared region, it is preferable to use metal or nonmetal phthalocyanine pigments as the charge generating material, and specifically, hydroxygallium phthalocyanine; chlorogallium phthalocyanine; dichlorotin phthalocyanine; and titanyl phthalocyanine are more preferable.

On the other hand, in order to corresponding to laser exposure in the near-ultraviolet region, as the charge generating material, condensed aromatic pigments such as dibromoanthanthrone; thioindigo pigments; porphyrazine compounds; zinc oxides; trigonal selenium; bisazo pigments; and the like are preferable.

In the case of using non-interfering light sources such as LED having a light emitting center wavelength at 450 nm to 780 nm and organic EL image arrays, the above charge generating materials may be used, but from the viewpoint of resolution, when a photosensitive layer is used as a thin film having a thickness of 20 μm or less, the electrical strength in the photosensitive layer increases, and thus, a decrease in charging by charge injection from a substrate, or image defects such as so-called a black spots are easily formed. This becomes apparent when a charge generating material easily causing generation of dark currents as a p-type semiconductor such as trigonal selenium and phthalocyanine pigment.

In this regard, in the case where n-type semiconductors such as condensed aromatic pigments, perylene pigments, azo pigments are used as a charge generating material, dark currents are not easily generated, and image defects called as a black spot may be prevented even when used as a thin film. Examples of the n-type charge generating material include the compounds (CG-1) to (CG-27) in paragraph Nos. [0288] to [0291] of JP-A-2012-155282, but are not limited thereto.

In addition, determination of n-type ones may be conducted as follows: by employing a time-of-flight method commonly used, with the polarity of photocurrents, electrons that are easily flown out than holes as a carrier are determined as a n-type one.

The binder resin used in the charge generating layer may be selected from a wide range of insulating resins, and further, the binder resin may be selected from organic photoconductive polymers such as poly-N-vinyl carbazole, polyvinyl anthracene, polyvinyl pyrene, and polysilane.

Examples of the binder resin include polyvinyl butyral resins, polyarylate resins (polycondensates of bisphenols and aromatic divalent carboxylic acid or the like), polycarbonate resins, polyester resins, phenoxy resins, vinyl chloride-vinyl acetate copolymers, polyamide resins, acrylic resins, polyacrylamide resins, polyvinyl pyridine resins, cellulose resins, urethane resins, epoxy resins, casein, polyvinyl alcohol resins, and polyvinyl pyrrolidone resins. The term "insulating" means that the volume resistivity is $10^{13}$ Ωcm or more.

These binder resins may be used singly or as a mixture of two or more kinds thereof.

Furthermore, the blending ratio of the charge generating material and the binder resin is preferably in the range of 10:1 to 1:10 by weight ratio.

In addition, well-known additives may be included in the charge generating layer.

The formation of the charge generating layer is not particularly limited, and well-known forming methods are used.

However, the formation of the charge generating layer is carried out by, for example, forming a coating film of a coating liquid for forming a charge generating layer, the coating liquid obtained by adding the components above to a solvent, and drying the coating film, followed by heating, as desired. Further, the formation may also be carried out by deposition of a charge generating material. The formation of charge generating layer by deposition is particularly suitable for a case of using a condensed aromatic pigment or a perylene pigment as a charge generating material.

Examples of the solvent used for the preparation of coating liquid for forming a charge generating layer include methanol, ethanol, n-propanol, n-butanol, benzyl alcohol, methyl cellosolve, ethyl cellosolve, acetone, methyl ethyl ketone, cyclohexanone, methyl acetate, n-butyl acetate, dioxane, tetrahydrofuran, methylene chloride, chloroform, chlorobenzene and toluene. These solvents may be used singly or as a mixture two or more kinds thereof.

For a method for dispersing particles (for example charge generating materials) in the coating liquid for forming a charge generating layer, for example, a media dispersing machine such as a ball mill, a vibrating ball mill, an attritor, a sand mill, and a horizontal sand mill, or a medialess dispersing machine such as a stirrer, an ultrasonic dispersing machine, a roll mill, and a high-pressure homogenizer is used. Examples of the high-pressure homogenizer include a collision system in which the particles are dispersed by causing the dispersion to collide against liquid or against walls under a high pressure, and a penetration system in which the particles are dispersed by causing the dispersion to penetrate through a fine flow path under a high pressure.

In addition, the average particle diameter of the charge generating materials in the coating liquid for forming a charge generating layer during the dispersion is effectively 0.5 μm or less, preferably 0.3 μm or less, and more preferably 0.15 μm or less.

The film thickness of the charge generating layer is set to a range of, for example, preferably from 0.1 μm to 5.0 μm, and more preferably from 0.2 μm to 2.0 μm.

Charge Transport Layer

The charge transport layer is, for example, a layer including a charge transporting material and a binder resin. The charge transport layer may be a layer including a polymeric charge transporting material.

Examples of the charge transporting material include electron transporting compounds, such as quinone compounds such as p-benzoquinone, chloranil, bromanil, and anthraquinone; tetracyanoquinodimethane compounds; fluorenone compounds such as 2,4,7-trinitro fluorenone; xanthone compounds; benzophenone compounds; cyanovinyl compounds; and ethylene compounds. Other examples of the charge transporting material include hole transport compounds such as triarylamine compounds, benzidine compounds, arylalkane compounds, aryl substituted ethylene compounds, stilbene compounds, anthracene compounds, and hydrazone compounds. These charge transporting materials may be used alone or in combination of two or more kinds thereof, but are not limited thereto.

The charge transporting material is preferably a triaryl amine derivative represented by the following formula (a-1) and a benzidine derivative represented by the following formula (a-2) from the viewpoint of charge mobility.

(a-1)

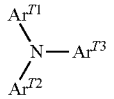

In the formula (a-1), $Ar^{T1}$, $Ar^{T2}$, and $Ar^{T3}$ each independently represent a substituted or unsubstituted aryl group, $—C_6H_4—C(R^{T4})=C(R^{T5})(T^{R6})$, or $—C_6H_4—CH=CH—CH=C(R^{T7})(R^{T8})$, and $R^{T4}$, $R^{T5}$, $R^{T6}$, $R^{T7}$, and $R^{T8}$ each independently represent a hydrogen atom, a substituted or unsubstituted alkyl group, or a substituted or unsubstituted aryl group.

Examples of the substituents of each of the above groups include a halogen atom, an alkyl group having 1 to 5 carbon atoms, an alkoxy group having 1 to 5 carbon atoms. Other examples of the substituents of each of the above groups include substituted amino groups substituted with an alkyl group having 1 to 3 carbon atoms.

(a-2)

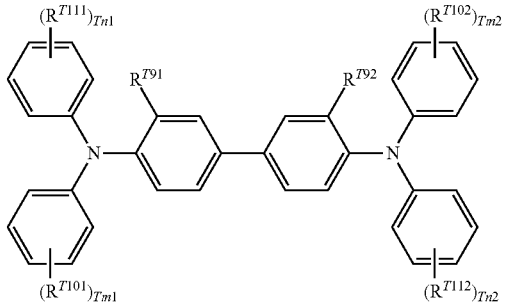

In the formula (a-2) $R^{T91}$ and $R^{T92}$ each independently represent a hydrogen atom, a halogen atom, an alkyl group having 1 to 5 carbon atoms, or an alkoxy group having 1 to 5 carbon atoms; $R^{T101}$, $R^{T102}$, $R^{T111}$ and $R^{T112}$ each independently represent a halogen atom, an alkyl group having 1 to 5 carbon atoms, an alkoxy group having 1 to 5 carbon atoms, an amino group substituted with an alkyl group having 1 or 2 carbon atoms, a substituted or unsubstituted aryl group, $—C(R^{T12})=C(R^{T13})(R^{T14})$, or $—CH=CH—CH=C(R^{T15})(R^{T15})$; $R^{T12}$, $R^{T13}$, $R^{T14}$, $R^{T15}$ and $R^{T16}$ each independently represent a hydrogen atom, a substituted or unsubstituted alkyl group, or a substituted or unsubstituted aryl group; and Tm1, Tm2, Tn1 and Tn2 each independently represent an integer of 0 to 2.

Examples of the substituents of each of the above groups include a halogen atom, an alkyl group having 1 to 5 carbon atoms, an alkoxy group having 1 to 5 carbon atoms. Other examples of the substituents of each of the above groups include substituted amino groups substituted with an alkyl group having 1 to 3 carbon atoms.

Here, among the triarylamine derivatives represented by the formula (a-1) and the benzidine derivatives represented by the formula (a-2), triarylamine derivatives having "$—C_6H_4—CH=CH—CH=C(R^{T7})(R^{T8})$" and benzidine derivatives having "$—CH=CH—CH=C(R^{T15})(R^{T16})$" are particularly preferable from the viewpoint of charge mobility.

As the polymeric charge transporting material, known materials having charge transporting properties such as poly-N-vinyl carbazole and polysilane are used. The polyester polymeric charge transporting materials are particularly preferable. Further, the polymeric charge transporting materials may be used singly or in combination with a binder resin.

Examples of the binder resin used in the charge transport layer include polycarbonate resins, polyester resins, polyarylate resins, methacrylic resins, acrylic resins, polyvinyl chloride resins, polyvinylidene chloride resins, polystyrene resins, polyvinyl acetate resins, styrene-butadiene copolymers, vinylidene chloride-acrylonitrile copolymers, vinyl chloride-vinyl acetate copolymers, vinyl chloride-vinyl acetate-maleic anhydride copolymers, silicone resins, silicone-alkyd resins, phenol-formaldehyde resins, styrene-alkyd resins, poly-N-vinyl carbazole, and polysilane. Among these, polycarbonate resins and polyarylate resins are suitable. These binder resins may be used singly or in combination of two or more kinds thereof.

Further, the blending ratio of the charge transporting material to the binder resin is preferably from 10:1 1 to 1:5 by weight ratio.

In addition, well-known additives may be included in the charge transport layer.

The formation of the charge transport layer is not particularly limited, and well-known forming methods are used. However, the formation of the charge transport layer is carried out by, for example, forming a coating film of a coating liquid for forming a charge transport layer, the coating liquid obtained by adding the components above to a solvent, and drying the coating film, followed by heating, as desired.

Examples of the solvent used for the coating solution for forming the charge transport layer include ordinary organic solvents, such as aromatic hydrocarbons such as benzene, toluene, xylene, and chlorobenzene; ketones such as acetone and 2-butanone; aliphatic hydrocarbon halides such as methylene chloride, chloroform, and ethylene chloride; and cyclic or straight-chained ethers such as tetrahydrofuran and ethyl ether. These solvents may be used singly or in combination of two or more kinds thereof.

The film thickness of the charge transport layer is set to a range to preferably 5 μm to 50 μm and more preferably 10 μm to 30 μm.

Protective Layer

The protective layer is provided on the photoreceptive layer as necessary. For example, the protective layer is provided in order to prevent a chemical change of the photoreceptive layer at a time of charging or to more improve mechanical strength of the photoreceptive layer.

For this reason, a layer configured by a cured film (crosslinking film) may be applied to the protective layer. As these layers, for example, a layer described by the following description (1) or (2) is included.

1) Layer configured by a cured film of a composition containing a reactive group-containing charge transporting material in which a reactive group and a charge transportable skeleton are contained in the same molecule (that is, a layer containing polymer of the reactive group-containing charge transporting material, or a crosslinking substance)

2) Layer configured by a cured film of a composition containing a non-reactive charge transporting material and a reactive group-containing no-charge transporting material which does not contain the charge transportable skeleton and contains a reactive group (that is, a layer containing the non-reactive charge transporting material, and polyer of the reactive group-containing no-charge transporting material, or a crosslinking substance)

Examples of the reactive group of the reactive group-containing charge transporting material include a known reactive group such as a chain polymeric group, an epoxy group, —OH, —OR (where, R indicates an alkyl group), —$NH_2$, —SH, —COOH, —$SiR^{Q1}{}_{3-Qn}(OR^{Q2})_{Qn}$ (where, $R^{Q1}$ indicates a hydrogen atom, an alkyl group, a substituted aryl group, or an unsubstituted aryl group, and $R^{Q2}$ indicates a hydrogen atom, an alkyl group, and a trialkylsilyl group. Qn indicates an integer of 1 to 3).

The chain polymeric group is not particularly limited as long as the chain polymeric group is a functional group enabling radical polymerization. For example, the chain polymeric group is a functional group having a group containing at least a carbon double bond. Specifically, an example of the chain polymeric group include a group containing at least one selected from a vinyl group, a vinyl ether group, a vinyl thioether group, a styryl group, an acryloyl group, a methacryloyl group, and derivatives of these substances. Among theses, as the chain polymeric group, a group containing at least one selected from the vinyl group, the styryl group, the acryloyl group, the methacryloyl group, and derivatives of these substances is preferable because of excellent reactivity.

The charge transportable skeleton of the reactive group-containing charge transporting material is not particularly limited as long as the charge transportable skeleton is a well-known structure in the electrophotographic photoreceptor. For example, the charge transportable skeleton may be a skeleton derived from a nitrogen containing hole transportable compound such as a triarylamine compound, a benzidine compound, and a hydrazone compound, and include a structure conjugated with a nitrogen atom. Among these, a triarylamine compound skeleton is preferable.

The reactive group-containing charge transporting material having the reactive group and the charge transportable skeleton, the non-reactive charge transporting material, and the reactive group-containing no-charge transporting material may be selected from known materials.

As a charge transportable material, a compound represented by the following formula (I) is preferable.

$$F—((—R^7—X)_{n1}(R^8)_{n3}—Y)_{n2} \quad (I)$$

In the formula (I), F indicates an organic group derived from a compound having hole transporting performance, each of $R^7$ and $R^8$ represent a straight-chain alkylene group or a branched-chain alkylene group having the number of carbons from 1 to 5, n1 represents 0 or 1, n2 represents an integer from 1 to 4, and n3 represents 0 or 1. X represents oxygen, NH, or a sulfur atom, and Y represents —OH, —$OCH_3$, —$NH_2$, —SH, or —COOH (already included in the reactive group).

As a compound having hole transporting performance in an organic group which is represented by F in the formula (I) and is derived from a compound having transporting performance, an arylamine derivative is appropriately included. As the arylamine derivative, a triphenylamine derivative and a tetraphenyl benzidine derivative are appropriately included.

As a specific example of the compound represented by the formula (I), compounds (I-1) to (I-31) represented as follows are included. The compound represented by the formula (I) is not limited to these compounds.

(I-1)
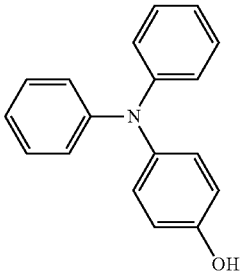
(I-2)
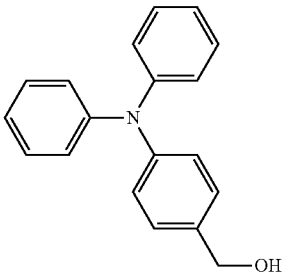
(I-3)
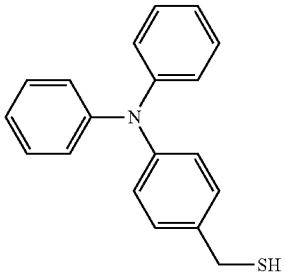
(I-4)
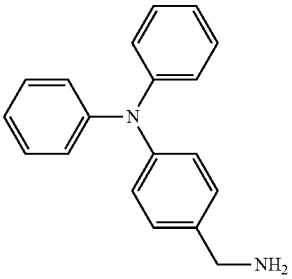
(I-5)
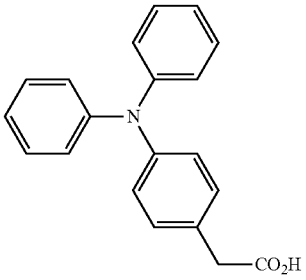
-continued
(I-6)
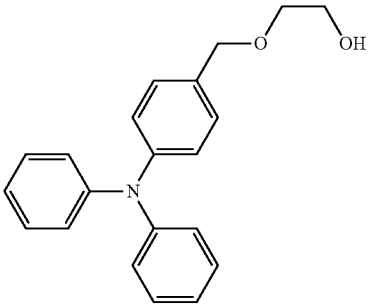
(I-7)
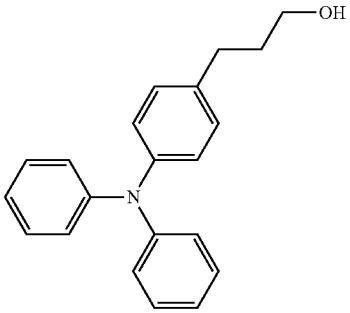
(I-8)
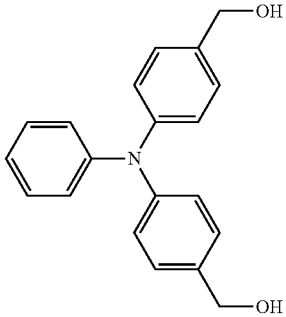
(I-9)
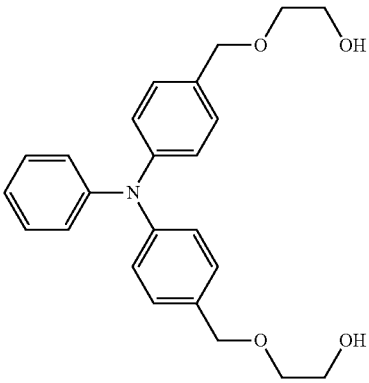

-continued
(I-10)
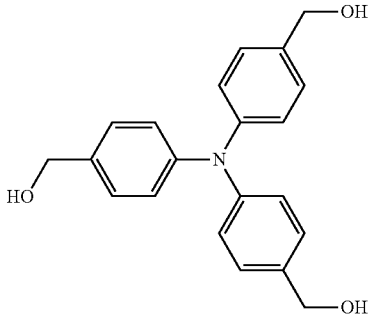
(I-11)
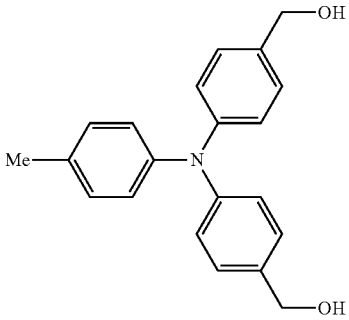
(I-12)
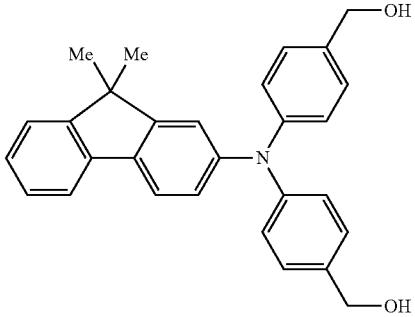
(I-13)
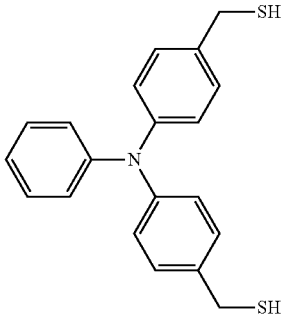
(I-14)
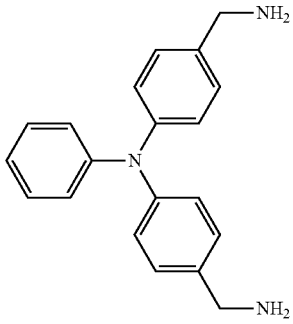
-continued
(I-15)
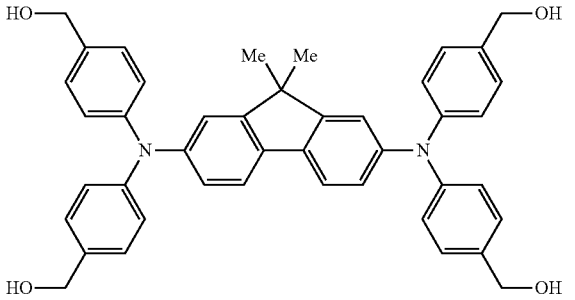
(I-16)
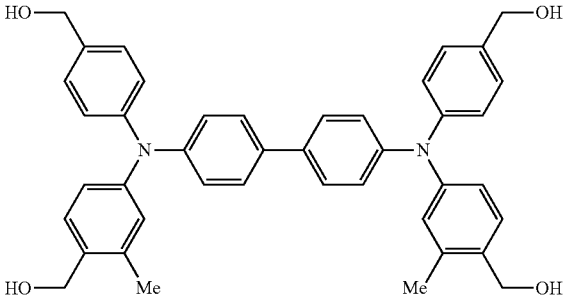
(I-17)
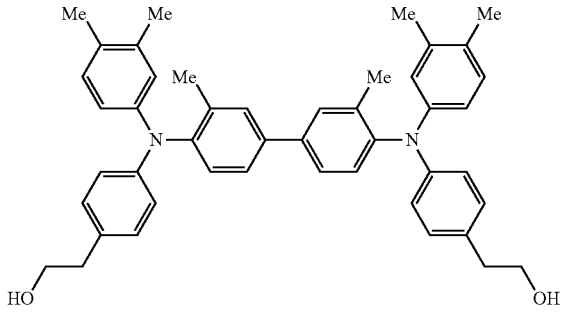
(I-18)
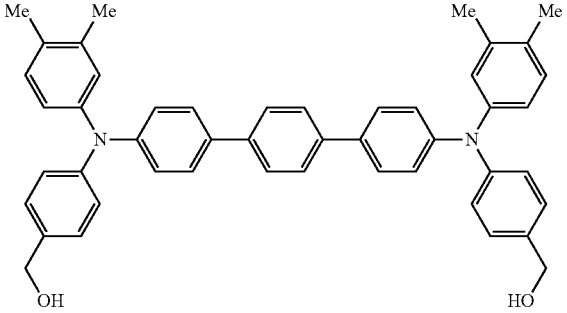
(I-19)
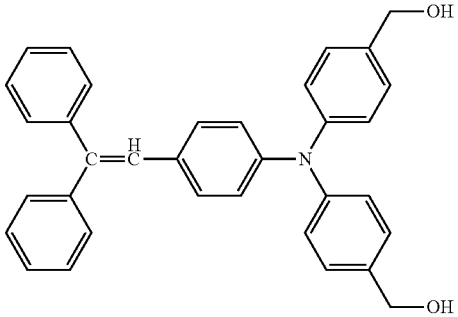

-continued
(I-20)
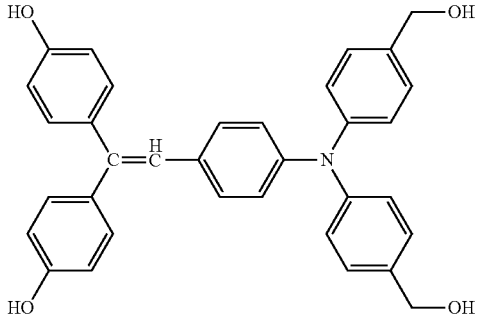
(I-21)
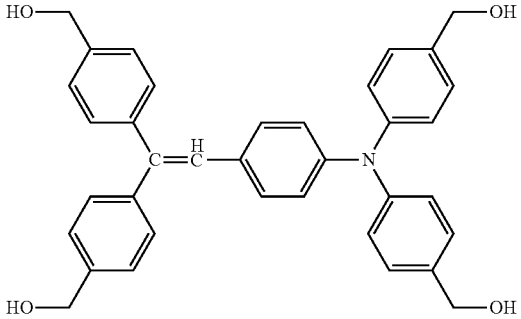
(I-22)
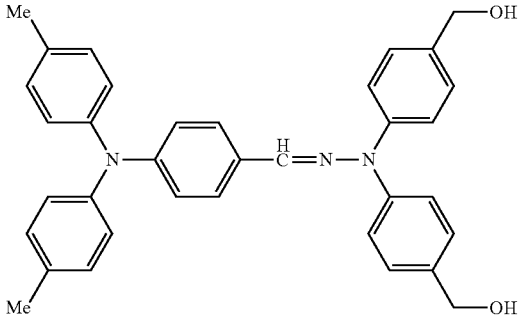
(I-23)
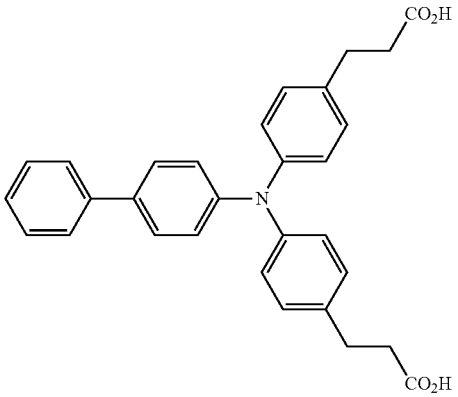
-continued
(I-24)
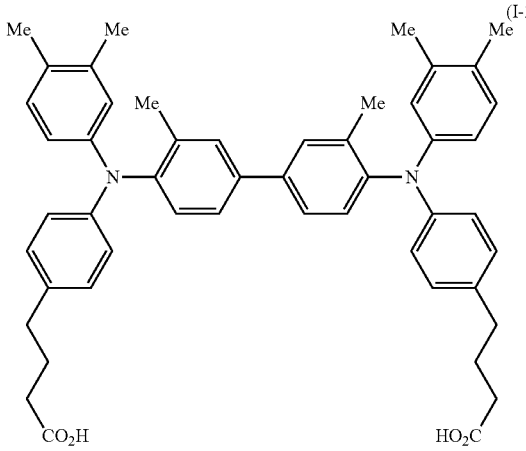
(I-25)
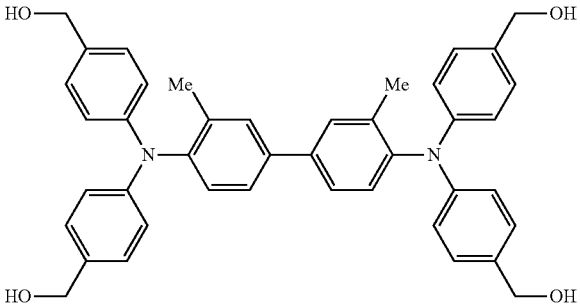
(I-26)
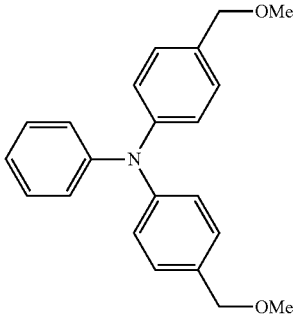
(I-27)
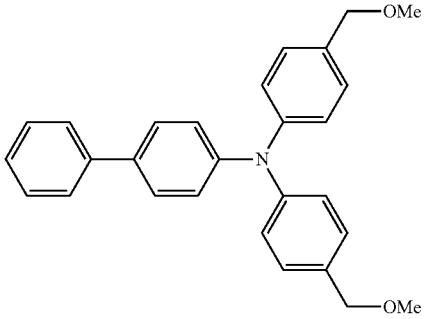

-continued (I-28)

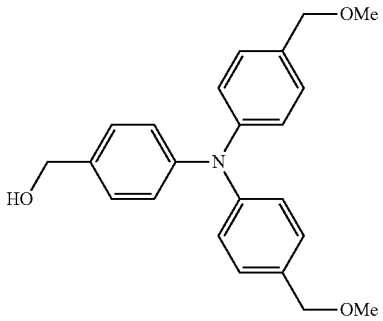

(I-29)

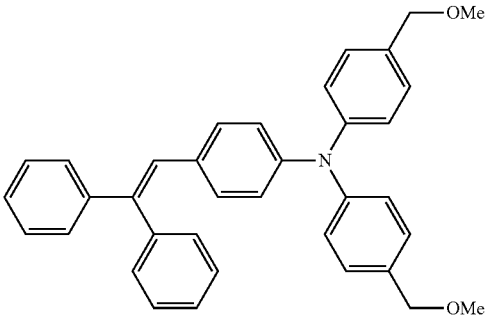

(I-30)

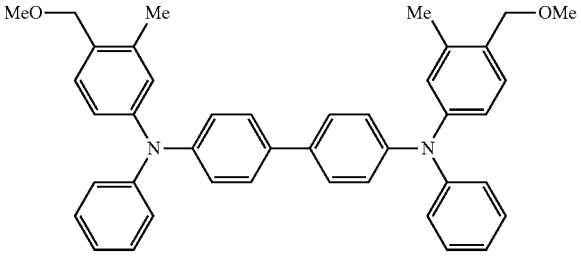

In addition, the protective layer may contain a known additive. For example, the protective layer may contain fluorine-containing particles. A material forming the fluorine-containing particles is not particularly limited as long as the material is a resin containing a fluorine atom. For example, the material may be formed from one type or two types or more selected from a tetrafluoroethylene resin (PTFE), a trifluorochloroethylene resin, a hexafluoride propylene resin, a vinyl fluoride resin, a vinylidene fluoride resin, a difluoroethylene dichloride resin, and copolymer of these substances. Among the fluororesins, the tetrafluoroethylene resin or vinylidene fluoride resin is preferable, and the tetrafluoroethylene resin is particularly preferable.

Formation of the protective layer is not particularly limited, and a known forming method is used. For example, a coated film is formed by using a coating liquid for forming the protective layer, obtained by adding the above-described component to a solvent. The coated film is dried, and is subjected to curing treatment such as heating, as necessary.

Examples of the solvent for preparing the coating liquid for forming the protective layer include an aromatic solvent such as toluene and xylene; a ketone solvent such as methyl ethyl ketone, methyl isobutyl ketone, and cyclohexanone; an ester solvent such as ethyl acetate and butyl acetate; an ether solvent such as tetrahydrofuran and dioxane; a Cellosolve solvent such as ethylene glycol monomethyl ether; an alcohol solvent such as isopropyl alcohol and butanol, and the like. These solvents are independently used or a mixture of two types or more of these solvents are used.

The coating liquid for forming the protective layer may be a coating liquid having no solvent.

The film thickness of the protective layer is preferably set to be in a range of from 1 μm to 20 μm, and more preferably set to be in a range of from 2 μm to 10 μm, for example.

Single Layer Type Photoreceptive Layer

The single layer type photoreceptive layer (charge generating/charge transport layer) is, for example, a layer containing the charge generating material, and the charge transporting material, and as necessary, a binder resin, and other known additives. These materials are similar to the materials described for the charge generating layer and the charge transport layer.

Furthermore, the content of the charge generating materials in the single layer type photosensitive layer is preferably from 10% by weight to 85% by weight, and more preferably from 20% by weight to 50% by weight, based on the total solid content. Further, the content of the charge transporting material in the single layer type photosensitive layer is preferably from 5% by weight to 50% by weight, based on the total solid content.

The method for forming the single layer type photosensitive layer is the same as the method for forming a charge generating layer or a charge transport layer.

The film thickness of the single layer type photosensitive layer may be, for example, preferably from 5 μm to 50 μm, and be more preferably from 10 μm to 40 μm.

The structure of the organic layer of the electrophotographic photoreceptor in the exemplary embodiment may have at least the photoreceptive layer. However, for example, the structure of the organic layer of the electrophotographic photoreceptor, and the average of the total film thickness d of the organic layer in the contact area with the charging member preferably have a relationship as follows.

When the electrophotographic photoreceptor includes the undercoat layer and the photoreceptive layer including the charge generating layer and the charge transport layer as the organic layers from the conductive substrate side, from a viewpoint of electrification characteristics, a wear life, productivity, or material cost, the average of the total film thickness d of the organic layer is preferably in a range of from 20 μm to 70 μm.

When the electrophotographic photoreceptor includes the undercoat layer, the charge generating layer, the charge transport layer, and the protective layer as the organic layers from the conductive substrate side, from a viewpoint of electrification characteristics, a wear life, productivity, or material cost, the average of the total film thickness d of the organic layer is preferably in a range of from 20 μm to 60 μm.

When the electrophotographic photoreceptor includes the single layer type photoreceptive layer as the organic layer, from a viewpoint of electrification characteristics, a wear life, productivity, or material cost, the average of the total film thickness d of the organic layer is preferably in a range of from 15 μm to 40 μm.

As the image forming apparatus according to the exemplary embodiment, a known image forming apparatus is applied: an apparatus including a fixing unit for fixing a toner image transferred onto a surface of a recording medium; a direct transfer apparatus that directly transfers a toner image formed on a surface of an electrophotographic photoreceptor onto a recording medium; an intermediate transfer apparatus that primarily transfers a toner image formed on a surface of an electrophotographic photoreceptor onto a surface of an intermediate transfer member, and then secondarily transfers the toner image which is primarily transferred onto the surface of the intermediate transfer member onto a surface of the recording medium; an apparatus including a cleaning unit that performs cleaning on a surface of an electrophotographic photoreceptor before charging; an apparatus including a erasing unit that performs erasing by irradiating a surface of an electrophotographic photoreceptor before charging with erasing light after a toner image is transferred; an apparatus including an electrophotographic photoreceptor heating member for increasing the temperature of the electrophotographic photoreceptor and reducing the relative temperature.

In the case of the intermediate transfer type device, for the transfer unit, for example, a configuration having an intermediate transfer member that has a surface to which the toner image is transferred, a primary transfer unit that primarily transfers a toner image formed on the surface of an image holding member to the surface of the intermediate transfer member, and a secondary transfer unit that secondarily transfers the toner image transferred to the surface of the intermediate transfer member is applied.

The image forming apparatus according to the exemplary embodiment may be anyone of a dry developing type image forming apparatus, a wet developing type (developing type using a liquid developer) image forming apparatus.

In the image forming apparatus according to the exemplary embodiment, for example, a part including the electrophotographic photoreceptor, the charging member, and the cleaning member may have a cartridge structure (process cartridge) which is detachable from the image forming apparatus. The process cartridge may include at least one selected from a group of, for example, an electrostatic latent image forming unit, a developing unit, and a transfer unit, in addition to the electrophotographic photoreceptor, the charging member, and the cleaning member.

Figure 7:
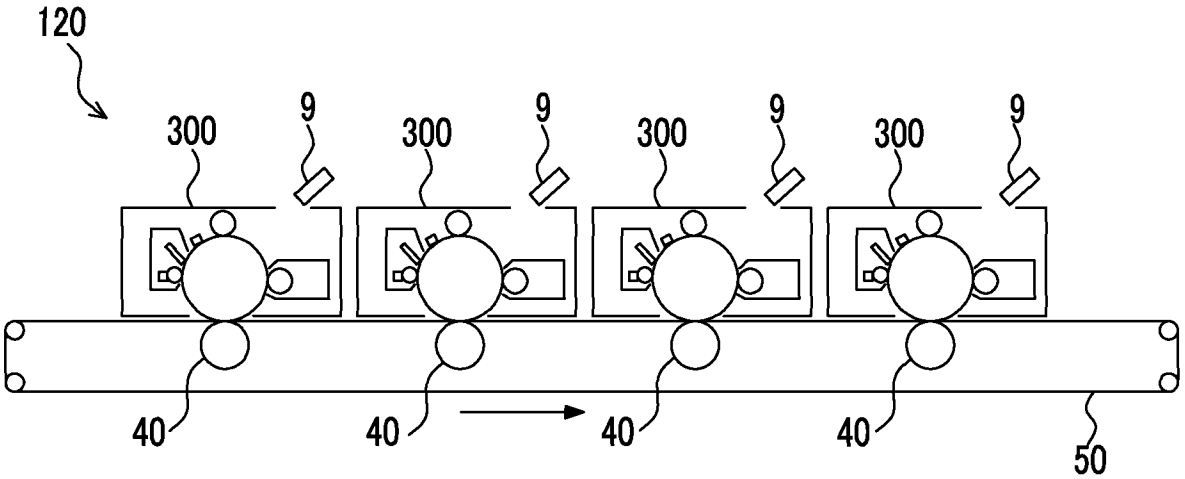
FIG. 7 is a schematic configuration diagram illustrating another example of the image forming apparatus according to the exemplary embodiment.

FIG. 7 is a schematic configuration diagram illustrating another example of the image forming apparatus according to the exemplary embodiment.

An image forming apparatus 120 illustrated in FIG. 7 is a tandem multicolor image forming apparatus in which four process cartridges 300 are installed. In the image forming apparatus 120, the four process cartridges 300 on the intermediate transfer member 50 are provided in parallel, and each process cartridge 300 has a configuration in which one electrophotographic photoreceptor to which one color is assigned is used. The image forming apparatus 120 may have a similar configuration to the image forming apparatus 100, except that it is a tandem type.

EXAMPLES

Examples and comparative examples will be described below. However, the exemplary embodiment of the invention is not limited to the following examples.

Preparation of Coating Liquid

Preparation of Coating Liquid for Forming Undercoat Layer 100 parts by weight of zinc oxide (average particle size: 70 nm, manufactured by Tayca Corporation, specific surface area value: 15 $m^2/g$) is mixed with 500 parts by weight of tetrahydrofuran with stirring. 1.25 parts by weight of KBM603 (manufactured by Shin-Etsu Chemical Co., Ltd) is added as the silane coupling agent and stirred for 2 hours. Then, tetrahydrofuran is subjected to distillation under reduced pressure and thus is distillated. Baking is performed at 120° C. for 3 hours, and thereby a silane coupling agent surface-treatment zinc oxide particles are obtained.

60 parts by weight of the zinc oxide particles subjected to the surface treatment, 0.6 parts by weight of alizarin, 13.5 parts by weight of blocked isocyanate (Sumidur 3173, manufactured by Sumitomo Bayer urethane Corporation) as the curing agent, and 15 parts by weight of a butyral resin (S-LEC BM-1, manufactured by Sekisui chemical Co., Ltd.) are dissolved in 85 parts by weight of methyl ethyl ketone, and thereby a solution is obtained. 38 parts by weight of the solution and 25 parts by weight of methyl ethyl ketone are mixed with each other, and a mixture obtained by mixing is dispersed in a sand mill by using glass beads having a diameter of 1 mm, for 4 hours. Thus, a dispersion is obtained.

0.005 parts by weight of dioctyl tin dilaurate as a catalyst and 4.0 parts by weight of silicone resin particles (Tospearl 145, manufactured by Momentive Performance Materials Inc.) are added to the obtained dispersion, and thereby the coating liquid for forming the undercoat layer is obtained.

Preparation of Coating Liquid for Forming Charge Generating Layer 2.5 parts by weight of chlorogallium phthalocyanine which has a strong diffraction peak at the Bragg angle ($2\theta \pm 0.2°$) of 7.4°, 16.6°, 25.5°, and 28.3° in an X-ray diffraction spectrum and 2.5 parts by weight of polyvinylbutyral (S-LEC BM-S, manufactured by Sekisui chemical Co., Ltd.) are mixed in 95 parts by weight of cyclohexanone, and a mixture obtained by mixing is dispersed along with glass beads having a diameter of 1 mm, in a paint shaker for 1 hour. Thus, the coating liquid for forming the charge generating layer having a solid content concentration of substantially 5.0% by weight is obtained.

Preparation of Coating Liquid for Forming Charge Transport Layer

Coating liquid 1 for forming charge transport layer: for three-layer photoreceptor 1 part by weight of tetrafluoroethylene resin particles, 0.02 parts by weight of fluorine grafted polymer, 5 parts by weight of tetrahydrofuran, and 2 parts by weight of toluene are sufficiently stirred and mixed, and thereby a tetrafluoroethylene resin particle suspension is obtained.

Then, 4 parts by weight of N,N'-diphenyl-N,N'-bis(3-methylphenyl)-[1,1']biphenyl-4,4'-diamine as the charge transporting material, and 6 parts by weight of a bisphenol Z type polycarbonate resin (viscosity average molecular weight of 40,000) are mixed and dissolved in a solvent containing 23 parts by weight of tetrahydrofuran and 10 parts by weight of toluene. Then, the tetrafluoroethylene resin particle suspension is added to be stirred and mixed, and then a dispersion treatment in which pressure increases up to 400 $kgf/cm^2$ ($3.92\times10^{-1}$ Pa) is repeated six times by using a high-pressure homogenizer (manufactured by Nanomizer Inc., product name: LA-33S) in which a penetration-type chamber having a fine outflow is mounted, and thereby a tetrafluoroethylene resin particle dispersion is obtained. 0.2 parts by weight of 2,6-di-t-butyl-4-methylphenol is mixed, and thereby Coating liquid 1 for forming the charge transport layer is obtained.

Coating Liquid 2 for Forming Charge Transport Layer: for four-layer photoreceptor having a protective layer 42 parts by weight of N,N'-bis(3-methylphenyl)-N,N'-diphenyl benzidine, and 58 parts by weight of a bisphenol Z type polycarbonate resin (TS2050, viscosity average molecular weight of 50,000, manufactured by Teijin Ltd.) are dissolved and mixed in a solvent which contains 280 parts by weight of tetrahydrofuran and 120 parts by weight of toluene. Thus, Coating liquid 2 for forming the charge transport layer is obtained.

Preparation of Coating Liquid for Forming Protective Layer 64 parts by weight of PTFE particles (LUBRON L-2, average particle size: 0.2 μm, manufacturedby Daikin Industries, Ltd.), 3.2 parts by weight of a disperse auxiliary agent (fluorine-containing comb-type graft polymer GF400, manufactured by Toagosei Co., Ltd.), and 333 parts by weight of cyclopentanone are mixed. Excitation with an ultrasonic wave is performed for 30 minutes, and then a result of excitation is dispersed in a nanomizer. Thus, a dispersion containing 16% by weight of the fluorine-containing particles (PTFE particles) is prepared.

Then, the following components are mixed and thereby the coating liquid for forming the protective layer is prepared.

Fluorine-containing particle dispersion: 17.8 parts by weight

Charge transporting material: 35 parts by weight

Thermosetting resin (benzoguanamine): 2.1 parts by weight

Oxidation inhibitor (Tris-TPM: Bis(4-diethylamino-2-methylphenyl)-(4-diethylaminophenyl)-methane): 0.2 parts by weight Catalyst (NACURE5225, manufactured by King Industries Inc.): 0.7 parts by weight Cyclopentanone: 27.7 parts by weight Cyclopentanol: 18.5 parts by weight As the charge transporting material, the above-described compounds (I-10) and (I-25) are used so as to have a mixing ratio (parts by weight) of 50/50.

Preparation of Coating Liquid for Forming Single Layer Type Photoreceptive Layer 50 parts by weight of the bisphenol Z type polycarbonate resin (viscosity average molecular weight: 50,000) as the binder resin, and 40 parts by weight of N,N'-diphenyl-N,N'-bis(3-methylphenyl)-1,1'-biphenyl-4,4'-diamine as the hole transfer material are dissolved in a solvent which contains 250 parts by weight of tetrahydrofuran and 250 parts by weight of toluene, and thereby a coating liquid P' for forming the photoreceptive layer is obtained.

1.5 parts by weight of a V type hydroxy gallium phthalocyanine pigment as the charge generating material, 50 parts by weight of the bisphenol Z type polycarbonate resin (viscosity average molecular weight: 50,000) as the binder resin, 11.5 parts by weight of 3,3'-di-tert-pentyl-dinaphthoquinone as the electron transporting material having the following structure, 37 parts by weight of N,N'-diphenyl-N,N'-bis(3-methylphenyl)-1,1'-biphenyl-4,4'-diamine as the hole transfer material, 250 parts by weight of tetrahydrofuran as a solvent, and 250 parts by weight of toluene are mixed, and thereby a mixture is obtained. The V type hydroxy gallium phthalocyanine pigment has diffraction peak at a position at which the Bragg angle)(20±0.2° in the X-ray diffraction spectrum using a Cukα characteristic X-ray is at least 7.3°, 16.0°, 24.9°, 28.0°. This mixture and the coating liquid P' for forming the photoreceptive layer before the dispersion treatment are mixed, and a mixture is dispersed in a DYNO mill by using glass beads having a diameter of 1 mmϕ, for 4 hours. Thus, the coating liquid P for forming the single layer type photoreceptive layer is obtained.

Manufacturing of Electrophotographic Photoreceptor

An electrophotographic photoreceptor described in the following example is prepared by using each of the coating liquid prepared as described above. The thickness of each layer, and the thickness of all of the organic layers (total film thickness) are measured by using the above-described method.

Example 1

Undercoat Layer Forming Process

The coating liquid for forming the undercoat layer is applied onto a cylindrical aluminum base (conductive substrate) having a diameter of 30 mm, a length of 340 mm, a thickness of 1 mm, by using the continuous ink jet method. Then, dry curing is performed at 180° C. for 100 minutes. The formed film by coating is patterned in such a manner that a movement speed of an ink jet head decreases at both end portions in the axis direction (at a time of coating start and at a time of coating completion), and thereby an undercoat layer having the thickness of 22.8 μm at the center portion in the axis direction is formed. Film formation conditions are as follows.

The number of nozzles of the head: 7

Nozzle diameter: ϕ22.5 μm

Interval between nozzles: 0.5 mm

Flow rate for one nozzle: 0.3 ml/min.

Piezoelectric drive: sinusoidal wave of 65.0 kHz

Application voltage: 3.0 V

Gap (distance between nozzle plate surface and cylindrical base): 10 mm

Head inclination angle: 80.0°

Head movement speed (when a film is formed at a constant speed): 156.8 mm/min.

Base rotation speed: 224 rpm

Charge Generating Layer Forming Process

The coating liquid for forming the charge generating layer is applied onto the undercoat layer by using the continuous ink jet method. Then, heating and drying are performed at 120° C. for 8 minutes, and thereby the charge generating layer having a thickness of 0.2 μm is formed. Film formation conditions are as follows.

The number of nozzles of the head: 4

Nozzle diameter: ϕ10 μm

Interval between nozzles: 1 mm

Flow rate for one nozzle: 0.05 ml/min.

Piezoelectric drive: sinusoidal wave of 65.0 kHz

Application voltage: 3.0 V

Gap: 1 mm

Head inclination angle: 80.0°

Head movement speed: 286.1 mm/min.

Base rotation speed: 411.9 rpm

Charge Transport Layer Forming Process

Coating liquid 1 for forming the charge transport layer is applied onto the base on which the charge generating layer is formed, by using the continuous ink j et method. Then, drying is performed at 135° C. for 40 minutes, and thereby the charge transport layer having a thickness of 37 μm is formed. Application conditions are as follows.

The number of nozzles of the head: 4

Nozzle diameter: ϕ26.5 μm

Interval between nozzles: 1 mm

Flow rate for one nozzle: 0.65 ml/min.

Piezoelectric drive: sinusoidal wave of 41.3 kHz

Application voltage: 3.0 V

Liquid temperature: 60° C.

Gap: 10 mm

Head inclination angle: 87°

Head movement speed (when a film is formed at a constant speed): 140 ram/min.

Base rotation speed: 280 rpm

The electrophotographic photoreceptor having a three-layer structure organic layer (length in axis direction: 329 mm) is prepared by the processes.

Example 2

An electrophotographic photoreceptor having a three-layer structure organic layer is prepared similarly to Example 1 except that the undercoat layer is formed at a constant speed along the entirety in the axis direction in Example 1, and the charge transport layer is patterned in such a manner that a movement speed of an ink jet head decreases at both end portions in the axis direction (from a time of coating start to a time of coating completion).

Example 3

An electrophotographic photoreceptor having a three-layer structure organic layer is prepared by sequentially forming the undercoat layer, the charge generating layer, and the charge transport layer, similarly to Example 1 except that the undercoat layer is formed at a constant speed along the entirety in the axis direction in Example 1 so as to have an average film thickness of 22.8 μm, Coating liquid 2 for forming the charge transport layer is used as a coating liquid for the charge transport layer, and the head movement speed is changed to 264 mm/min. and the base rotation speed is changed to 528 rpm such that the charge transport layer has an average film thickness of 18.5 μm.

Protective Layer Forming Process

The coating liquid for forming the protective layer is applied onto the charge transport layer by using the continuous ink jet method. Then, drying is performed at 150° C. for 30 minutes, and thereby the protective layer having a thickness of substantially 7 μm is formed. The formed film by coating is patterned in such a manner that a movement speed of an ink jet head decreases at both end portions in the axis direction (from a time of coating start to a time of coating completion). Film formation conditions are as follows.

The number of nozzles of the head: 7
Nozzle diameter: ϕ11.0 μm
Interval between nozzles: 0.5 mm
Flow rate for one nozzle: 0.07 ml/min.
Piezoelectric drive: sinusoidal wave of 65.0 kHz
Application voltage: 3.0 V
Gap: 1 mm
Head inclination angle: 80.0°
Head movement speed: 232.4 mm/min.
Base rotation speed: 764.4 rpm Example 4

An electrophotographic photoreceptor having a three-layer structure organic layer is prepared by sequentially forming the undercoat layer, the charge generating layer, and the charge transport layer, similarly to Example 1 except that a film is formed to have a pattern at both end portions by decreasing a movement speed of the ink jet head, in forming of the charge transport layer in Example 1 and the thickness at both of the end portions is adjusted to be 40 μm.

Example 5

Pattern film formation is performed similarly to Example 3 except that the undercoat layer and the charge generating layer are formed similarly to Example 4, and the charge transport layer is patterned in such a manner that movement speed of the ink jet head decreases at both end portions in the axis direction (from a time of coating start to a time of coating completion). The protective layer is formed on the charge transport layer to have a pattern similarly to Example 3, and thereby an electrophotographic photoreceptor having a four-layer structure organic layer is prepared.

Example 6

A single layer type photoreceptive layer is formed on a cylindrical aluminum base (conductive substrate) having a diameter of 30 mm, a length of 340 mm, a thickness of 1 mm, so as to have a pattern by using the coating liquid P for forming the single layer type photoreceptive layer, and thereby the single layer type electrophotographic photoreceptor is prepared. Film formation conditions for the single layer type photoreceptive layer are similar to the film formation conditions for the charge transport layer in Example 1 except that pattern film formation is performed by decreasing the movement speed of the ink jet head at both of the end portions.

Comparative Example 1

An electrophotographic photoreceptor having a three-layer structure organic layer is prepared similarly to Example 4 except that a pattern to be formed at both of the end portions is changed in pattern film formation of the undercoat layer and the charge transport layer in Example 4.

Comparative Example 2

Manufacturing of Electrophotographic Photoreceptor

Coating is sequentially performed by using a dipping coating method and drying is performed, and thereby the undercoat layer, the charge generating layer, and the charge transport layer are sequentially formed on a cylindrical aluminum substrate (conductive substrate).

Undercoat Layer Forming Process

The coating liquid for forming the undercoat layer is applied onto a cylindrical aluminum base (conductive substrate) having a diameter of 30 mm, a length of 340 mm, a thickness of 1 mm, by using the dipping coating method. Then, dry curing is performed at 160° C. for 100 minutes.

Coating is performed in such a manner that a rising speed of the substrate is set to 160 ram/min., and the substrate rises in the axis direction. When a coated film is formed at an upper end portion of the substrate (at a time of coating start), the rising speed is adjusted and the coated film is formed.

After rising, the coated film at a lower end portion is wiped. After drying, the undercoat layer having a thickness of 22.8 μm at the center portion in the axis direction is obtained.

Charge Generating Layer Forming Process

The coating liquid for forming the charge generating layer is applied onto the base on which the undercoat layer is formed, by using the dipping coating method. Then, heating and drying are performed at 120° C. for 8 minutes, and thereby the charge generating layer having a thickness of 0.2 μm is formed. Coating is performed in such a manner that a rising speed of the substrate is set to 150 mm/min. After rising, the coated film at the lower end portion is wiped.

Charge Transport Layer Forming Process

Coating liquid 1 for forming the charge transport layer is applied onto the base on which the charge generating layer is formed, by using the dipping coating method. Then, drying is performed at 115° C. for 40 minutes, and thereby the charge transport layer having a thickness of 37 μm is formed.

Coating is performed in such a manner that a rising speed of the substrate is set to 200 mm/min., and the substrate rises in the axis direction. When a coated film is formed at an upper end portion of the substrate (at a time of coating start), the rising speed is adjusted and the coated film is formed.

Comparative Example 3

Similarly to Comparative Example 2, the undercoat layer and the charge generating layer are formed on an aluminum base by using the dipping coating method.

Charge Transport Layer Forming Process

Coating liquid 2 for forming the charge transport layer is applied onto the base on which the charge generating layer is formed, by using the dipping coating method. Then, drying is performed at 115° C. for 40 minutes, and thereby the charge transport layer having a thickness of 18.5 μm is formed.

Coating is performed in such a manner that a rising speed of the substrate is set to 120 mm/min., and the substrate rises in the axis direction. When a coated film is formed at an upper end portion of the substrate (at a time of coating start), the rising speed is adjusted and the coated film is formed.

Protective Layer Forming Process

The coating liquid for forming the protective layer is applied onto the charge transport layer by using the dipping coating method. Then, drying is performed at 150° C. for 30 minutes, and thereby the protective layer having a thickness of substantially 7 μm is formed. Coating is performed in such a manner that a rising speed of the substrate is set to 150 ram/min., and the substrate rises in the axis direction. When a coated film is formed at an upper end portion of the substrate (at a time of coating start), the rising speed is adjusted and the coated film is formed.

Comparative Example 4

A single layer type photoreceptive layer is formed on a cylindrical aluminum base (conductive substrate) having a diameter of 30 mm, a length of 340 mm, a thickness of 1 mm, so as to have a pattern in such a manner that the coating liquid P for forming the single layer type photoreceptive layer is formed to have a pattern by using the dip coating method, and thereby the single layer type electrophotographic photoreceptor is prepared. Coating is performed in such a manner that a rising speed of the substrate is set to 150 mm/min., and the substrate rises in the axis direction. When a coated film is formed at an upper end portion of the substrate (at a time of coating start), the rising speed is adjusted and the coated film is formed.

Regarding the electrophotographic photoreceptor prepared in each of examples, film forming conditions of the organic layer other than the charge generating layer are shown in Table 1 below.

TABLE 1

| | | | Coating conditions | | |
|---|---|---|---|---|---|
| | Film forming method | Organic layers other than charge generating layer | Head movement speed at a time of a constant speed (mm/min.) | Rotation speed (rpm) | Film formation pattern (End portion treatment) |
| Example 1 | ink jet method | undercoat layer | 156.8 | 224 | pattern film formation (speed decreasing at both ends) |
| | | charge transfer layer | 140 | 280 | film formation at constant speed |
| Example 2 | ink jet method | undercoat layer | 156.8 | 224 | film formation at constant speed |
| | | charge transfer layer | 140 | 280 | pattern film formation (speed decreasing at both ends) |
| Example 3 | ink jet method | undercoat layer | 156.8 | 224 | film formation at constant speed |
| | | charge transfer layer | 264 | 528 | film formation at constant speed |
| | | protective layer | 232.4 | 764.5 | pattern film formation (speed decreasing at both ends) |
| Example 4 | ink jet method | undercoat layer | 156.8 | 224 | pattern film formation (speed decreasing at both ends) |
| | | charge transfer layer | 140 | 280 | pattern film formation (speed decreasing at both ends) |
| Example 5 | ink jet method | undercoat layer | 156.8 | 224 | pattern film formation (speed decreasing at both ends) |
| | | charge transfer layer | 264 | 528 | pattern film formation (speed decreasing at both ends) |
| | | protective layer | 232.4 | 764.4 | pattern film formation (speed decreasing at both ends) |
| Example 6 | ink jet method | single layer photoreceptive layer | 140 | 280 | pattern film formation (speed decreasing at both ends) |
| Comparative Example 1 | ink jet method | undercoat layer | 156.8 | 224 | pattern film formation (speed decreasing at both ends) |
| | | charge transfer layer | 140 | 280 | pattern film formation (speed decreasing at both ends) |

TABLE 1-continued

| | Film forming method | Organic layers other than charge generating layer | Coating conditions: Head movement speed at a time of a constant speed (mm/min.) | Rotation speed (rpm) | Film formation pattern (End portion treatment) |
|---|---|---|---|---|---|
| Comparative Example 2 | dipping coating method | undercoat layer | 160 | — | speed adjusting at upper end wiping at lower end |
| | | charge transfer layer | 200 | — | speed adjusting at upper end wiping at lower end |
| Comparative Example 3 | dipping coating method | undercoat layer | 160 | — | speed adjusting at upper end wiping at lower end |
| | | charge transfer layer | 120 | — | speed adjusting at upper end wiping at lower end |
| | | protective layer | 150 | — | speed adjusting at upper end wiping at lower end |
| Comparative Example 4 | dipping coating method | single layer photoreceptive layer | 150 | — | speed adjusting at upper end wiping at lower end |

Evaluation

The electrophotographic photoreceptor which is prepared as described above in each of examples is mounted in a bench model machine of a monochromatic developing system, and copying of a 300×1,000 cycle is performed. Thus, occurrence of an image defect (band-shaped lines on a print sample) due to leakage at the end portion in the axis direction of the photoreceptor is observed.

In all of the examples, the charging roll and the cleaning blade have the following configuration.

Charging Roll

Material of contact area with photoreceptor: polyamide resin in which a conductive agent is dispersed Length of surface layer in axis direction (length of contact area with photoreceptor): 312 mm Cleaning Blade Material of contact area with photoreceptor: urethane rubber Width of blade (length of contact area with photoreceptor): 316 mm The total film thickness of the organic layer in the electrophotographic photoreceptor, the length a of the area A in the axis direction, the length b of the area B in the axis direction, and an evaluation result are shown in Table 2 below. The area A is an area from the end portion of the contact area of the electrophotographic photoreceptor and the charging member to the end portion of the contact area of the electrophotographic photoreceptor and the cleaning member. The area B is an area from the end portion of the contact area with the cleaning member of the electrophotographic photoreceptor to the maximum total film thickness portion of the organic layer.

TABLE 2

| | Total film thickness of organic layer: Average at center portion d (μm) | Film formation start side (upper end side): a (mm) | b (mm) | d' (μm) | d"min (μm) | d"max (μm) | d'/d | d"/d | d" max/d | Film formation completion side (lower end side): a (mm) | b (mm) | d' (μm) | d"min (μm) | d"max (μm) | d'/d | d"/d | d" max/d | Evaluation result Leakage resistance |
|---|---|---|---|---|---|---|---|---|---|---|---|---|---|---|---|---|---|---|
| Example 1 | 60.0 | 2 | 2 | 60.2 | 60.2 | 62.0 | 1.00 | 1.03 | 1.03 | 2 | 2 | 60.3 | 60.5 | 61.9 | 1.01 | 1.01 | 1.03 | no occurrence of leakage |
| Example 2 | 60.0 | 2 | 2 | 60.1 | 60.2 | 63.5 | 1.00 | 1.06 | 1.06 | 2 | 2 | 60.3 | 60.5 | 63.0 | 1.01 | 1.01 | 1.05 | no occurrence of leakage |
| Example 3 | 48.5 | 2 | 3 | 47.5 | 47.8 | 49.0 | 0.98 | 1.01 | 1.01 | 2 | 3 | 47.2 | 47.5 | 48.9 | 0.97 | 0.98 | 1.01 | no occurrence of leakage |
| Example 4 | 60.0 | 2 | 2 | 59.5 | 60.0 | 65.0 | 0.99 | 1.08 | 1.08 | 2 | 2 | 59.5 | 60.0 | 66.0 | 0.99 | 1.00 | 1.10 | no occurrence of leakage |
| Example 5 | 48.5 | 2 | 3 | 48.0 | 48.1 | 51.2 | 0.99 | 1.06 | 1.06 | 2 | 3 | 48.0 | 48.2 | 50.5 | 0.99 | 0.99 | 1.04 | no occurrence of leakage |
| Example 6 | 24.0 | 2 | 3 | 24.0 | 24.0 | 25.2 | 1.00 | 1.05 | 1.05 | 2 | 3 | 24.0 | 24.0 | 25.3 | 1.00 | 1.00 | 1.05 | no occurrence of leakage |
| Comparative | 60.0 | 2 | (3) no max- | 55.0 | 52.7 | 53.5 | 0.92 | 0.89 | 0.89 | 2 | (3) no max- | 54.8 | 51.9 | 52.9 | 0.91 | 0.87 | 0.88 | occurrence of |

TABLE 2-continued

| | Total film thickness of organic layer | | | | | | | | | | | | | | | | | | |
|---|---|---|---|---|---|---|---|---|---|---|---|---|---|---|---|---|---|---|---|
| | Average at center portion d (μm) | Film formation start side (upper end side) | | | | | | | | Film formation completion side (lower end side) | | | | | | | | | Evaluation result Leakage resistance |
| | | a (mm) | b (mm) | d' (μm) | d"min (μm) | d"max (μm) | d'/d | d"/d | d" max/d | a (mm) | b (mm) | d' (μm) | d"min (μm) | d"max (μm) | d'/d | d"/d | d" max/d | | |
| Example 1 | | | imum portion | | | | | | | | imum portion | | | | | | | | leakage at both ends |
| Comparative Example 2 | 60.0 | 2 | (3) no maximum portion | 45.4 | 35.0 | 44.0 | 0.76 | 0.73 | 0.73 | 2 | 3 | 59.5 | 58.8 | 66.0 | 0.99 | 0.98 | 1.10 | | occurrence of leakage at upper end |
| Comparative Example 3 | 48.5 | 2 | (3) no maximum portion | 41.5 | 29.5 | 35.0 | 0.86 | 0.72 | 0.72 | 2 | 3 | 47.1 | 46.4 | 49.1 | 0.97 | 0.96 | 1.01 | | occurrence of leakage at both ends |
| Comparative Example 4 | 24.0 | 2 | (3) no maximum portion | 19.9 | 12.0 | 16.5 | 0.83 | 0.69 | 0.69 | 2 | 3 | 23.6 | 24.1 | 26.7 | 0.98 | 1.00 | 1.11 | | occurrence of leakage at upper end |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an electrophotographic photoreceptor that includes a conductive substrate and an organic layer which is provided on the conductive substrate and includes at least a photoreceptive layer;

a charging member that contacts with a surface of the electrophotographic photoreceptor and charges the surface of the electrophotographic photoreceptor;

an electrostatic latent image forming unit that forms an electrostatic latent image on the surface of the electrophotographic photoreceptor;

a developing unit that develops the electrostatic latent image which is formed on the surface of the electrophotographic photoreceptor by using a developer containing a toner, to form a toner image;

a transfer unit that transfers the toner image to a surface of a recording medium; and a cleaning member that contacts with the surface of the electrophotographic photoreceptor so as to perform cleaning on the surface of the electrophotographic photoreceptor, wherein a contact area of the electrophotographic photoreceptor and the cleaning member in an axis direction of the electrophotographic photoreceptor is wider than a contact area of the electrophotographic photoreceptor and the charging member, maximum total film thickness portions at each of both end portions in the axis direction of the electrophotographic photoreceptor, at which a total film thickness of the organic layer becomes the greatest are included at a non-contact area with the cleaning member, and when an average of the total film thickness of the organic layer in a contact area with the charging member is set as d, the total film thickness of the organic layer in a non-contact area with the charging member and in an area A from an end portion of the contact area with the charging member to an end portion of the contact area with the cleaning member in the axis direction of the electrophotographic photoreceptor is set as d', the total film thickness of the organic layer in the non-contact area with the cleaning member and in an area B from the end portion of the contact area with the cleaning member in the axis direction of the electrophotographic photoreceptor to the maximum total film thickness portion is set as d", and the total film thickness of the maximum total film thickness portion of the organic layer is set as d"max, all the following relational expressions (1) to (3) are satisfied at each of both of the end portions in the axis direction of the electrophotographic photoreceptor;

$$0.97 \leq d'/d \leq 1.03 \quad (1)$$

$$0.97 \leq d''/d \leq 1.1 \quad (2)$$

$$1.03 \leq d''\text{max}/d \leq 1.1 \quad (3).$$

2. The image forming apparatus according to claim 1, wherein the relational expression (1) satisfies the following relationship:

$$0.98 \leq d'/d \leq 1.02.$$

3. The image forming apparatus according to claim 1, wherein the relational expression (2) satisfies the following relationship:

$$0.98 \leq d''/d \leq 1.05.$$

4. The image forming apparatus according to claim 1, wherein the relational expression (3) satisfies the following relationship:

$$1.03 \leq d''\max/d \leq 1.05.$$

5. The image forming apparatus according to claim 1, wherein when a length of the area A in the axis direction of the electrophotographic photoreceptor is set as a, the following relationship is satisfied:

$$1\ \text{mm} \leq a \leq 5\ \text{mm}.$$

6. The image forming apparatus according to claim 1, wherein when a length of the area A in the axis direction of the electrophotographic photoreceptor is set as a, the following relationship is satisfied:

$$1\ \text{mm} \leq a \leq 3\ \text{mm}.$$

7. The image forming apparatus according to claim 1, wherein when a length of the area B in the axis direction of the electrophotographic photoreceptor is set as b, the following relationship is satisfied:

$$0.1\ \text{mm} \leq b \leq 10\ \text{mm}.$$

8. The image forming apparatus according to claim 1, wherein when a length of the area B in the axis direction of the electrophotographic photoreceptor is set as b, the following relationship is satisfied:

$$0.1\ \text{mm} \leq b \leq 5\ \text{mm}.$$

9. The image forming apparatus according to claim 1, wherein the electrophotographic photoreceptor includes, as the organic layer, an undercoat layer and the photoreceptive layer which includes a charge generating layer and a charge transport layer, from the conductive substrate side, and the average of the total film thickness d of the organic layer is in a range of from 20 μm to 70 μm.

10. The image forming apparatus according to claim 1, wherein the electrophotographic photoreceptor includes, as the organic layer, an undercoat layer, a charge generating layer, a charge transport layer, and a protective layer, from the conductive substrate side, and the average of the total film thickness d of the organic layer is in a range of from 20 μm to 60 μm.

11. The image forming apparatus according to claim 1, wherein the electrophotographic photoreceptor includes a single layer type photoreceptive layer as the organic layer, and the average of the total film thickness d of the organic layer is in a range of from 15 μm to 40 μm.

12. A process cartridge that is detachable from an image forming apparatus, comprising:

an electrophotographic photoreceptor that includes a conductive substrate and an organic layer which is provided on the conductive substrate and includes at least a photoreceptive layer;

a charging member that contacts with a surface of the electrophotographic photoreceptor and charges the surface of the electrophotographic photoreceptor; and a cleaning member that contacts with the surface of the electrophotographic photoreceptor so as to perform cleaning on the surface of the electrophotographic photoreceptor, wherein a contact area of the electrophotographic photoreceptor and the cleaning member in an axis direction of the electrophotographic photoreceptor is wider than a contact area of the electrophotographic photoreceptor and the charging member, maximum total film thickness portions at each of both end portions in the axis direction of the electrophotographic photoreceptor, at which the total film thickness of the organic layer becomes the greatest are included at a non-contact area with the cleaning member, when an average of the total film thickness of the organic layer in a contact area with the charging member is set as d, a total film thickness of the organic layer in a non-contact area with the charging member and in an area A from an end portion of the contact area with the charging member to an end portion of the contact area with the cleaning member in the axis direction of the electrophotographic photoreceptor is set as d', the total film thickness of the organic layer in the non-contact area with the cleaning member and in an area B from the end portion of the contact area with the cleaning member in the axis direction of the electrophotographic photoreceptor to the maximum total film thickness portion is set as d'', and the total film thickness of the maximum total film thickness portion of the organic layer is set as d''max, all the following relational expressions (1) to (3) are satisfied at each of both of the end portions in the axis direction of the electrophotographic photoreceptor;

$$0.97 \leq d'/d \leq 1.03 \quad (1)$$

$$0.97 \leq d''/d \leq 1.1 \quad (2)$$

$$1.03 \leq d''\max/d \leq 1.1 \quad (3).$$

* * * * *